US011808066B2

(12) United States Patent
Pedersen et al.

(10) Patent No.: US 11,808,066 B2
(45) **Date of Patent: *Nov. 7, 2023**

(54) FLUID GUARD AND ABSORBER FOR LOCKING DEVICES

(71) Applicant: KNOX Associates, Inc., Phoenix, AZ (US)

(72) Inventors: Jason Pedersen, Phoenix, AZ (US); Dominik Scheffler, Phoenix, AZ (US)

(73) Assignee: KNOX Associates, Inc., Phoenix, AZ (US)

( * ) Notice: Subject to any disclaimer, the term of this patent is extended or adjusted under 35 U.S.C. 154(b) by 359 days.

This patent is subject to a terminal disclaimer.

(21) Appl. No.: 17/031,632

(22) Filed: Sep. 24, 2020

(65) Prior Publication Data

US 2021/0079686 A1 Mar. 18, 2021

Related U.S. Application Data

(63) Continuation of application No. 16/056,192, filed on Aug. 6, 2018, now Pat. No. 10,801,233.

(Continued)

(51) Int. Cl.
*E05B 9/00* (2006.01)
*E05B 47/00* (2006.01)

(Continued)

(52) U.S. Cl.
CPC ..... *E05B 9/002* (2013.01); *E05B 17/183* (2013.01); *E05B 47/0045* (2013.01);

(Continued)

(58) Field of Classification Search
CPC ..... E05B 9/002; E05B 17/183; E05B 67/00; E05B 85/02; E05B 77/34; E05B 47/0045;

(Continued)

(56) References Cited

U.S. PATENT DOCUMENTS 908,844 A 12/1907 Cuming
1,369,506 A * 2/1921 Voight ..... E05B 17/183 70/455

(Continued)

FOREIGN PATENT DOCUMENTS

CN 201 517 324 6/2010
CN 205243206 U 5/2016

(Continued)

OTHER PUBLICATIONS

ABUS 83WPIB-53 Submariner Brass Body Stainless Steel Shackle Padlock Keyed Alike, http://abuspadlocksonline.co.uk/abus-padlocks/abus-submariner-padlocks/abus-83wpib-53-submariner-padlock-keyed-alike.html, 3 pages, Feb. 6, 2018.

(Continued)

*Primary Examiner* — Christine M Mills
*Assistant Examiner* — Christopher F Callahan
(74) *Attorney, Agent, or Firm* — Knobbe, Martens, Olson & Bear, LLP

(57) ABSTRACT

Described herein are example fluid guards that can be used with locking devices. Various aspects may be particularly applicable to electrical locks, but they may also be applicable to mechanical locks. A locking device guard can include a guard head, a guard body, and a hinge. The guard head may include a fluid absorber, a frame that is shaped to receive the fluid absorber, and a fastening mechanism. The guard body can be coupled with an electronic lock. The guard body can include an aperture that is configured to expose a face of the electronic lock.

20 Claims, 24 Drawing Sheets

Related U.S. Application Data

(60) Provisional application No. 62/678,960, filed on May 31, 2018, provisional application No. 62/651,965, filed on Apr. 3, 2018.

(51) Int. Cl.

| | |
|---|---|
| ***E05B 77/34*** | (2014.01) |
| ***E05B 85/02*** | (2014.01) |
| ***H01R 13/52*** | (2006.01) |
| ***E05B 67/00*** | (2006.01) |
| ***E05B 17/18*** | (2006.01) |

(52) U.S. Cl.
CPC ..... *E05B 67/00* (2013.01); *E05B 77/34* (2013.01); *E05B 85/02* (2013.01); *H01R 13/5213* (2013.01)

(58) Field of Classification Search
CPC ..... E05B 17/188; E05B 67/02; E05B 67/38; E05B 65/0075; E05B 17/002; E05B 17/14; E05B 17/142; E05B 17/181; E05B 67/04; E05B 2067/386; E05B 17/16; H01R 13/5213; H01R 13/5216; H01R 13/5219; H01R 13/5221; Y10S 70/43; Y10S 70/56; Y10T 70/485; Y10T 70/487; Y10T 70/493; Y10T 70/496; Y10T 70/498; Y10T 70/7955; Y10T 70/796; Y10T 70/7966; Y10T 70/7972; Y10T 70/7977; Y10T 70/7983; Y10T 70/8649; Y10T 70/8514
USPC ..... 70/423–428, 455, 450, 50, 51, 54–56, 70/DIG. 43, DIG. 56
See application file for complete search history.

(56) References Cited

U.S. PATENT DOCUMENTS 1,662,612 A 3/1928 Junkunc
2,096,568 A 10/1937 Snively
2,564,012 A * 8/1951 Jordan ..... E05B 77/34 70/455
2,904,985 A 9/1959 Murphy
2,931,209 A 4/1960 Dies
2,988,910 A 6/1961 Eshbaugh
3,583,185 A 6/1971 Jacobi
3,625,035 A 12/1971 Brummer
3,740,981 A 6/1973 Patriquin
3,975,935 A 8/1976 Masterson
4,023,388 A 5/1977 Morvai
4,154,072 A 5/1979 Flaschar
4,218,902 A 8/1980 Druschel
4,262,508 A 4/1981 Davidson
4,282,732 A 8/1981 Bennett
4,286,445 A 9/1981 Sills
4,317,344 A * 3/1982 Barnard ..... E05B 17/002 70/55
4,638,652 A 1/1987 Morse
4,709,567 A 12/1987 Appelbaum
4,799,565 A 1/1989 Handa et al.
4,825,673 A 5/1989 Drake
5,241,846 A 9/1993 Hoke
5,253,786 A 10/1993 Schmidt
5,363,678 A 11/1994 Meckbach
5,377,511 A 1/1995 Meckbach
5,586,459 A * 12/1996 Bullock ..... E05B 13/108 70/216
5,615,567 A 4/1997 Kemp
5,758,529 A 6/1998 Chhatwal
5,761,935 A * 6/1998 Adelmeyer ..... E05B 17/002 70/455
5,921,123 A 7/1999 Schwarzkopf et al.
6,240,755 B1 6/2001 Da Silva
D448,648 S 10/2001 Bremicker
D449,772 S 10/2001 Bremicker
D449,971 S 11/2001 Schell
D451,001 S 11/2001 Bremicker
D454,293 S 3/2002 Bremicker
6,425,274 B1 7/2002 Laitala et al.
6,457,336 B1 10/2002 Bremicker
6,467,316 B1 * 10/2002 Chen ..... E05B 67/02 70/423
6,507,980 B2 1/2003 Bremicker
6,584,815 B2 7/2003 Bremicker
6,668,606 B1 12/2003 Russell et al.
6,718,806 B2 4/2004 Davis
D492,183 S 6/2004 Becker
6,761,051 B1 * 7/2004 Tsai ..... E05B 47/0012 70/279.1
D497,303 S 10/2004 Sun
6,813,914 B2 * 11/2004 Chen ..... E05B 17/002 70/52
7,036,344 B2 5/2006 Gast et al.
D553,951 S 10/2007 Meckbach
7,278,283 B2 10/2007 Meckbach
D559,655 S 1/2008 Meckbach
D579,756 S 11/2008 Hentschel et al.
7,533,549 B2 5/2009 Gunther
D608,180 S 1/2010 Buseman
7,694,541 B2 4/2010 Shum
7,712,339 B2 5/2010 Hentschel et al.
D628,524 S 12/2010 Golling
7,845,202 B2 12/2010 Padilla et al.
8,037,722 B2 10/2011 Ng et al.
D651,354 S 12/2011 Santini
8,083,037 B2 12/2011 Weiershausen
8,085,137 B2 12/2011 Weiershausen
8,127,577 B2 3/2012 Buhl et al.
D657,657 S 4/2012 Golling
D658,037 S 4/2012 Golling
8,151,604 B2 4/2012 Thomas et al.
8,156,772 B2 4/2012 Buhl et al.
D660,683 S 5/2012 Golling
D660,684 S 5/2012 Golling
D661,026 S 5/2012 Santini
D663,073 S 7/2012 Santini
D663,074 S 7/2012 Santini
8,225,631 B2 7/2012 Becker
8,245,547 B1 8/2012 Garthe
D668,394 S 10/2012 Santini
D672,094 S 12/2012 Santini
8,347,660 B2 1/2013 Guenther
8,353,186 B2 1/2013 Schaefer
8,418,513 B2 4/2013 Buhl et al.
8,596,103 B2 12/2013 Weiershausen
8,656,746 B2 2/2014 Buhl
8,695,390 B2 4/2014 Ng et al.
8,739,582 B2 4/2014 Diesing
D711,723 S 8/2014 Garthe
8,857,229 B2 10/2014 Cheevers et al.
8,875,552 B2 11/2014 Fan
8,915,107 B2 12/2014 Hertel et al.
8,973,417 B2 3/2015 Bench et al.
D736,058 S 8/2015 Garthe
D738,187 S 9/2015 Garthe
9,194,159 B2 11/2015 Garthe
D745,366 S 12/2015 Ocklenburg
9,200,473 B2 12/2015 Fan et al.
9,217,265 B2 12/2015 Muller et al.
9,222,282 B2 12/2015 Russo et al.
9,322,196 B2 4/2016 Garthe et al.
D759,899 S 6/2016 Finiel
9,388,606 B2 7/2016 Garthe et al.
D778,140 S 2/2017 Heinemann et al.
D781,133 S 3/2017 Heinemann et al.
9,631,401 B2 4/2017 Garthe et al.
D787,300 S 5/2017 Ocklenburg
9,689,179 B2 6/2017 Fan et al.
D790,954 S 7/2017 Ocklenburg
D808,256 S 1/2018 Muller
9,938,061 B2 4/2018 Garthe
D817,739 S 5/2018 Ocklenburg

(56) References Cited

U.S. PATENT DOCUMENTS

| | | | |
|---|---|---|---|
| D817,740 | S | 5/2018 | Ocklenburg |
| 9,969,449 | B2 | 5/2018 | Maraffio et al. |
| D820,662 | S | 6/2018 | Kuchler |
| 10,006,224 | B2 | 6/2018 | Wehr |
| D825,313 | S | 8/2018 | Ocklenburg |
| 10,053,890 | B2 | 8/2018 | Hommel |
| 10,081,404 | B2 | 9/2018 | Heinemann et al. |
| 10,087,655 | B2 | 10/2018 | Pankratius et al. |
| 10,801,233 | B2 * | 10/2020 | Pedersen ..... E05B 47/0045 |
| 2001/0022097 | A1 | 9/2001 | Bremicker |
| 2002/0002850 | A1 | 1/2002 | Bremicker |
| 2002/0026694 | A1 | 3/2002 | Bremicker |
| 2003/0041630 | A1 | 3/2003 | Laitala et al. |
| 2004/0055342 | A1 * | 3/2004 | Chen ..... E05B 17/002 70/56 |
| 2004/0113039 | A1 | 6/2004 | Becker |
| 2005/0000255 | A1 | 1/2005 | Wyers |
| 2005/0092038 | A1 | 5/2005 | Becker |
| 2005/0235709 | A1 | 10/2005 | Meckbach |
| 2007/0095112 | A1 | 5/2007 | Meyer |
| 2008/0066501 | A1 | 3/2008 | Tang |
| 2008/0134730 | A1 | 6/2008 | Becker |
| 2009/0007606 | A1 | 1/2009 | Gunther |
| 2009/0025437 | A1 | 1/2009 | Hentschel et al. |
| 2009/0049875 | A1 | 2/2009 | Buhl et al. |
| 2009/0145704 | A1 | 6/2009 | Weiershausen |
| 2009/0145705 | A1 | 6/2009 | Weiershausen |
| 2009/0199602 | A1 | 8/2009 | Diesing |
| 2009/0223259 | A1 | 9/2009 | Guenther |
| 2009/0223264 | A1 | 9/2009 | Lennhoff et al. |
| 2009/0277230 | A1 | 11/2009 | Shum |
| 2010/0050716 | A1 | 3/2010 | Fan |
| 2010/0300165 | A1 | 12/2010 | Fan et al. |
| 2010/0319414 | A1 | 12/2010 | Schaefer |
| 2010/0319417 | A1 | 12/2010 | Ng et al. |
| 2010/0319420 | A1 | 12/2010 | Ng et al. |
| 2011/0048082 | A1 | 3/2011 | Thomas et al. |
| 2011/0154870 | A1 | 6/2011 | Buhl et al. |
| 2011/0156544 | A1 | 6/2011 | Jakobsen et al. |
| 2011/0162416 | A1 | 7/2011 | Becker |
| 2011/0239715 | A1 | 10/2011 | Weiershausen |
| 2011/0252846 | A1 | 10/2011 | Hertel et al. |
| 2012/0167640 | A1 | 7/2012 | Buhl et al. |
| 2012/0167641 | A1 | 7/2012 | Guenther |
| 2012/0186308 | A1 | 7/2012 | Garthe |
| 2012/0192599 | A1 | 8/2012 | Garthe |
| 2013/0014548 | A1 | 1/2013 | Fan et al. |
| 2013/0067972 | A1 | 3/2013 | Buhl |
| 2013/0205848 | A1 | 8/2013 | Langenberg et al. |
| 2014/0042201 | A1 | 2/2014 | Weiershausen et al. |
| 2014/0311196 | A1 | 10/2014 | Garthe et al. |
| 2014/0352375 | A1 | 12/2014 | Hertel et al. |
| 2014/0360233 | A1 | 12/2014 | Muller et al. |
| 2014/0360234 | A1 | 12/2014 | Garthe |
| 2015/0114050 | A1 | 4/2015 | Garthe et al. |
| 2015/0314933 | A1 | 11/2015 | Garthe |
| 2015/0315822 | A1 | 11/2015 | Garthe et al. |
| 2015/0361691 | A1 | 12/2015 | Garthe et al. |
| 2016/0021967 | A1 | 1/2016 | Finiel |
| 2016/0145896 | A1 | 5/2016 | Ulrich et al. |
| 2016/0186461 | A1 | 6/2016 | Wehr |
| 2016/0186462 | A1 | 6/2016 | Wehr |
| 2016/0201358 | A1 | 7/2016 | Garthe |
| 2016/0368552 | A1 | 12/2016 | Heinemann et al. |
| 2016/0368556 | A1 | 12/2016 | Maraffio et al. |
| 2016/0369531 | A1 | 12/2016 | Hommel |
| 2017/0101808 | A1 | 4/2017 | Fan |
| 2017/0120975 | A1 | 5/2017 | Kuchler et al. |
| 2017/0254113 | A1 | 9/2017 | Pankratius et al. |
| 2017/0267305 | A1 | 9/2017 | Muller |
| 2018/0030758 | A1 | 2/2018 | Wehr |
| 2018/0098593 | A1 | 4/2018 | Von Dunten et al. |
| 2018/0155957 | A1 * | 6/2018 | Vardi ..... E05B 17/002 |
| 2018/0202196 | A1 | 7/2018 | Diesing |
| 2018/0245369 | A1 | 8/2018 | Buchmuller |
| 2018/0258668 | A1 | 9/2018 | Buseman |
| 2019/0301198 | A1 | 10/2019 | Pedersen et al. |

FOREIGN PATENT DOCUMENTS

| | | | |
|---|---|---|---|
| DE | 37 16 370 | | 11/1988 |
| DE | 37 16 384 | | 11/1988 |
| DE | 92 18 330 | | 2/1994 |
| DE | 102016125283 | A1 | 6/2018 |
| DE | 102016125515 | A1 | 6/2018 |
| DE | 102017101029 | A1 | 7/2018 |
| DE | 102017101503 | A1 | 7/2018 |
| DE | 202018103318 | U1 | 7/2018 |
| DE | 102017104102 | A1 | 8/2018 |
| DE | 102017105031 | A1 | 9/2018 |
| DE | 102017105133 | A1 | 9/2018 |
| EP | 3064419 | B1 | 6/2018 |
| EP | 3339542 | A1 | 6/2018 |
| EP | 3351712 | A1 | 7/2018 |
| EP | 2266868 | B1 | 8/2018 |
| EP | 2372054 | B1 | 8/2018 |
| EP | 2796646 | B1 | 8/2018 |
| EP | 3354828 | A1 | 8/2018 |
| EP | 3359762 | A1 | 8/2018 |
| EP | 3366873 | A1 | 8/2018 |
| EP | 2628874 | B1 | 9/2018 |
| EP | 2942458 | B1 | 9/2018 |
| EP | 3106376 | B1 | 9/2018 |
| EP | 3372762 | A1 | 9/2018 |
| EP | 3372764 | A1 | 9/2018 |
| EP | 3550098 | A1 | 10/2019 |
| EP | 3845728 | A1 | 7/2021 |
| KR | 101 563 981 | | 10/2015 |
| KR | 101563981 | B1 * | 10/2015 |
| WO | WO 2018/114400 | A1 | 6/2018 |

OTHER PUBLICATIONS 7000-0037 Extreme Environment Covers Sell Sheet, Master Lock Company LLC, Feb. 2014.
ABUS, Brass Padlock 70, Art. No. 23144, 1 page, Oct. 2015.
ABUS 2018 Price List, ABUS USA, pp. 1-40.
ABUS USA 2018 Safety Catalog, pp. 1-52.
ABUS USA 2018 Security Catalog, pp. 1-60.
ABUS August Bremicker Söhne KG, Interchangeable Core—83 Padlock Series Guide, https://www.abus.com/eng/Guide/83-Padlock-Series/Interchangeable-Core, Feb. 7, 2018, 2 pages.
Master Lock Commercial Security Products Technical Manual, Electronic Update Sep. 2013, 40 pages.
CyberLock, The Lock on Intelligence, Videx 2005.
European Search Report, EP 18187514.7, dated Jan. 30, 2019.
Medeco ASSA ABLOY, Padlocks, 18 pages.
Medeco ASSA ABLOY XT Electronic Control, Accountability, Security Brochure, 2011.
PCT Search Report and Written Opinion, PCT/US2018/045422, dated Jan. 30, 2019.
Sample ABUS Products, May 15, 2018
European Search Report, EP 20203637, dated Jun. 9, 2021.

* cited by examiner

FLUID GUARD AND ABSORBER FOR LOCKING DEVICES

INCORPORATION BY REFERENCE TO ANY RELATED APPLICATIONS

Any and all applications, if any, for which a foreign or domestic priority claim is identified in the Application Data Sheet of the present application are hereby incorporated by reference under 37 CFR 1.57.

BACKGROUND

Electronic locks have a number of advantages over normal mechanical locks. For example, electronic locks may be encrypted so that only a key carrying the correct code will operate the lock. In addition, an electronic lock may contain a microprocessor so that, for example, a record can be kept of who has operated the lock during a certain time period or so that the lock is only operable at certain times. An electronic lock may also have the advantage that, if a key is lost, the lock may be reprogrammed to prevent the risk of a security breach and to avoid the expense associated with replacement of the entire lock.

SUMMARY

Described herein are example fluid guards that can be used with locking devices. Various aspects may be particularly applicable to electrical locks, but they may also be applicable to mechanical locks.

For purposes of summarizing the disclosure, certain aspects, advantages and novel features are discussed herein. It is to be understood that not necessarily all such aspects, advantages or features will be embodied in any particular embodiment disclosed herein, and a myriad of combinations of such aspects, advantages, or features may be implemented.

A locking device guard can include a guard head, a guard body, and a hinge. The guard head may include a fluid absorber, a frame that is shaped to receive the fluid absorber, and a fastening mechanism. The guard body can be coupled with an electronic lock. The guard body can include an aperture that is configured to expose a face of the electronic lock. The aperture may also receive the fluid absorber. The fluid absorber may contact the face of the electronic lock and to thereby absorb fluid off of the face of the electronic lock. The guard body may further include a fastening receiver that is configured to mate with the fastening mechanism. The hinge can connect the guard head and the guard body and be configured to define an open position and a closed position of the locking device guard.

A locking device guard head can include a fluid absorber. The fluid absorber can be inserted into a cup of a face of a lock. The fluid absorber may also absorb fluid from the face of the lock. The guard head can also include a frame that is shaped to receive the fluid absorber. The guard head can include a fastening mechanism. The locking device guard head can prevent a flow of fluid from an exterior of the guard head to the face of the lock.

A locking device guard can be used on an access panel of an access box. The locking device guard can include a latch of the access panel. The locking device guard may include a guard door, a guard body, and a hinge. The guard door may be attached to the latch of the access panel. The guard door can include a fluid absorber. The guard base may be attached to the access panel of the access box. The guard base can include an aperture and a flange. The aperture may be configured to expose a face of an electronic lock that is disposed within the access panel. The aperture may also be configured to receive the fluid absorber, for example, so as to permit the fluid absorber to contact the face of the electronic lock and to thereby permit absorption of fluid off of the face of the electronic lock. The flange may be disposed at least partially about the aperture. The hinge can connect the guard base and the guard door and be configured to define an open position and a closed position of the locking device guard.

BRIEF DESCRIPTION OF THE DRAWINGS

The following drawings and the associated descriptions are provided to illustrate embodiments of the present disclosure and do not limit the scope of the claims.

DETAILED DESCRIPTION

Figure 1A:
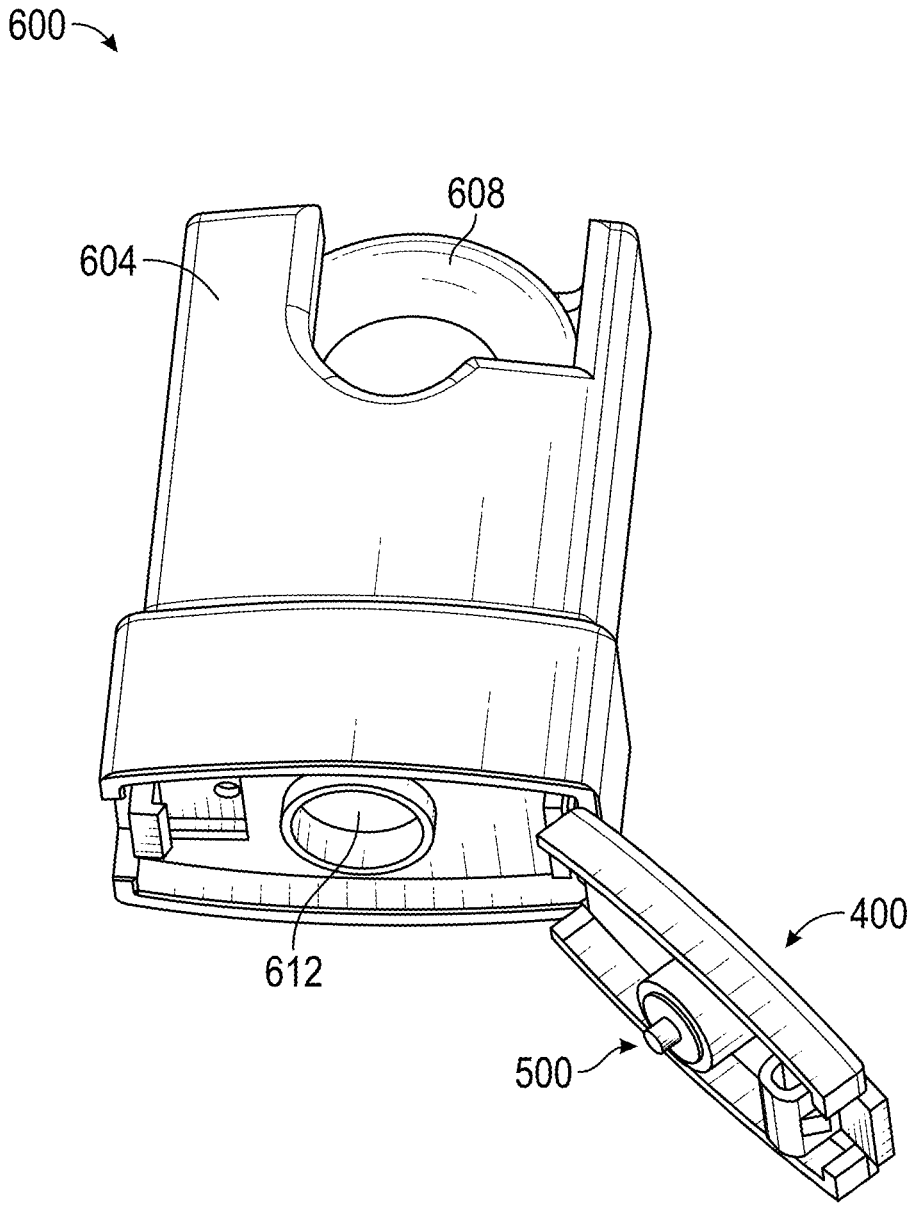
FIG. 1A shows a perspective view of an example lock assembly.

Various structures can be used to cover a lock body. For example, locking devices may include weatherproofing features. Some designs may include providing one or more seals on a padlock body and/or on a key. However, many shortcomings of the prior art exist for which this application provides beneficial and novel solutions.

Described herein are example fluid guards that can be used with locking devices. Various aspects may be particularly applicable to electrical locks, but they may also be applicable to mechanical locks. Electrical or mechanical locks can be used in secure boxes, cabinets, and the like. These locks may be susceptible to problems cause by fluids, such as water, oils, solvents, acids, bases, salts, alcohols, and other fluids containing ketones, salts, glycols, or esters. For example, electronic locking devices may be damaged and/or rendered less effective in the presence of fluids, which can cause short circuits or otherwise disrupt communications. To protect a lock from fluids or other harmful substances, a fluid guard may be used.

A lock can be outfitted with a fluid guard described herein. The fluid guard can prevent fluids or dust from coming in contact with certain parts of the lock, such as a face of the lock. Some parts of a lock may be particularly sensitive to changes in physical dimensions, such as at a lock face, where a key may be inserted. Repeated exposure to fluid can be accompanied with an accumulation of rust, debris, microorganisms, and/or a variety of other undesirable effects.

Fluid guards described herein may also improve the functionality of the lock itself. Some electronic locking mechanisms may operate on a principle of inductance or capacitance, and fluid between lock and key components could change the distance between those components and therefore negatively affect communications. For example, an electronic lock may include a partial capacitor comprising a capacitive metal plate in communication with a processor. The capacitive metal plate of the partial capacitor can form a capacitor with a corresponding capacitive metal plate of a key when brought into proximity with the metal plate of the lock, thereby allowing for capacitive data or power transfer between the lock and key. Some examples of such locking mechanisms are disclosed in U.S. Pat. No. 9,710,981, titled "Capacitive Data Transfer in An Electronic Lock and Key Assembly," filed May 5, 2015 ("the '981 patent"), which is incorporated by reference herein in its entirety for all purposes.

Any fluid between these capacitive plates may change the distance between the plates and hence the capacitance, which can limit the ability of the key and lock to communicate effectively or at all. Thus, the fluid guard can be used to prevent or reduce the incidence of fluids covering the capacitive plate of the lock. Further, the fluid guard can include a fluid-absorbent material that can wipe or wick away fluid from the face of the capacitive plate of the lock.

Although the included figures and following description focus on a fluid guard for an example padlock, it should be understood that the fluid guard can be adapted to protect an electronic or mechanical lock included in a cabinet or in another enclosure or other type of lock.

Example Padlock with Fluid Guard

FIG. 1A shows an example lock assembly 600 that includes a lock cover 604, a shackle 608, and a fluid guard 400. The lock assembly 600 may include a plurality of internal components not shown here. For example, the lock assembly 600 may include an electronic lock core (see, for example, FIG. 11). As described herein, electronic lock cores can have a variety of features and functionality that can be implemented in any type of lock, such as a padlock, lockbox, cabinet, door, or the like. Examples of some such locks can be found in the '981 patent referred to above. The lock assembly 600 may instead include a mechanical lock core. As shown, the example fluid guard 400 shown can be attached to the lock cover 604 and/or to a body of the lock assembly 600. The fluid guard 400 can include an example fluid absorber 500 that can absorb or wick away fluid from a lock face 612 (see also FIG. 1B).

Figure 1B:
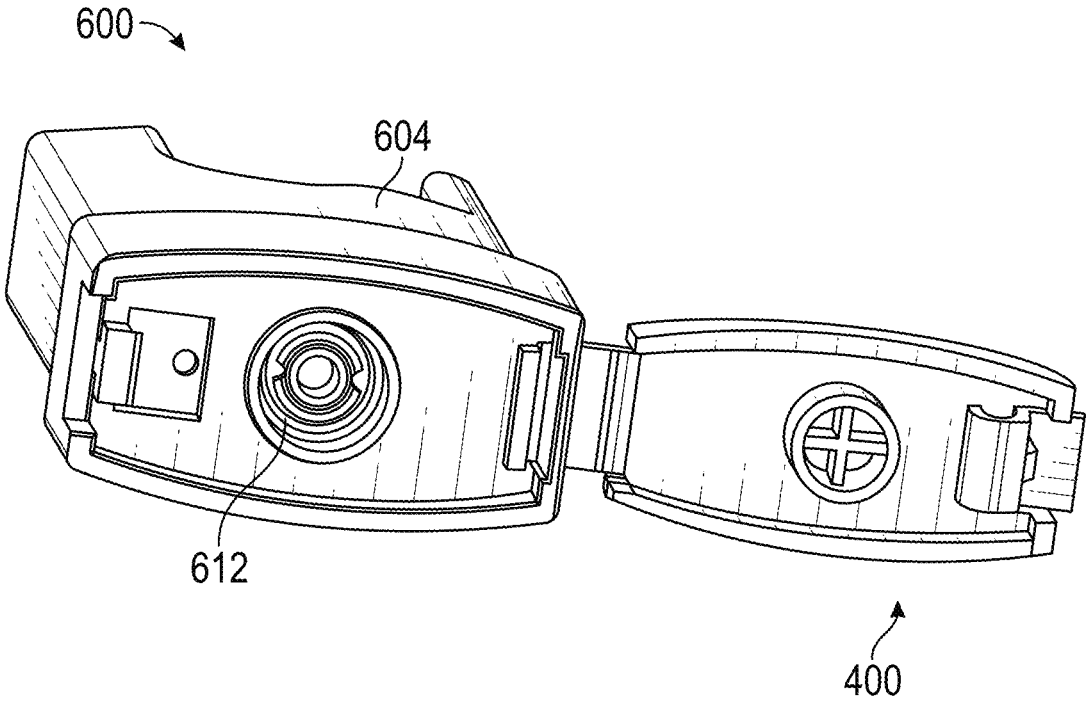
FIG. 1B shows a perspective view of a portion of the example lock assembly of FIG. 1A, depicting a lock face.

FIG. 1B shows a perspective view of the example lock assembly of FIG. 1A, including a more detailed example lock face 612. The lock face 612 may include an interface where a key comes in contact with the lock assembly. For example, the lock face 612 can be one end of a lock core. The lock core can be electronic or mechanical. The lock face 612 of an electronic lock core may include a capacitive interface, as described in more detail herein. The fluid absorber 500 is not shown but is described in more detail below.

Figure 2:
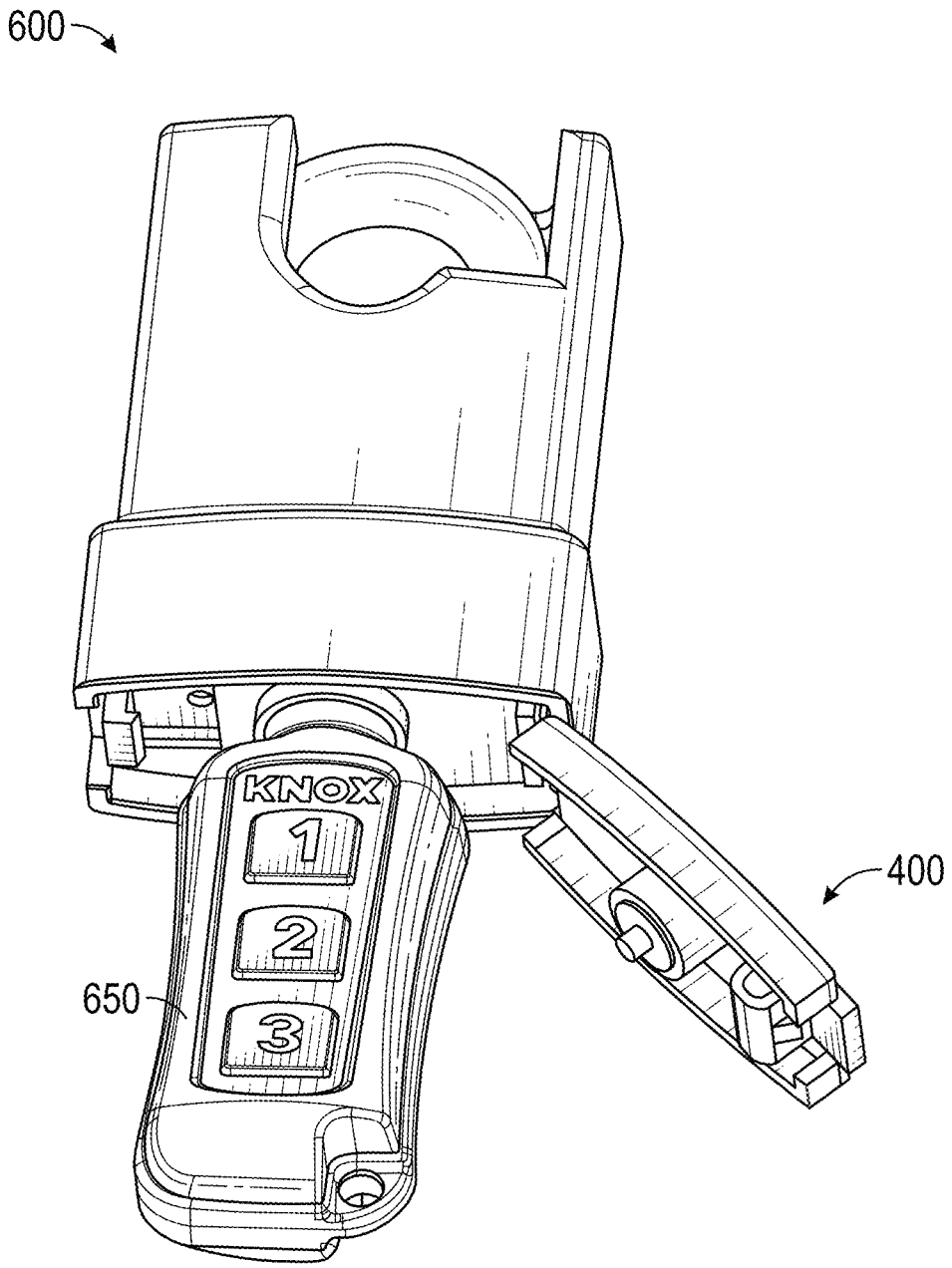
FIG. 2 shows the lock assembly of FIG. 1A that includes an electronic key.

FIG. 2 shows the example embodiment of FIG. 1A where an electronic key 650 has been inserted through an opening in the fluid guard 400 and into the body of the lock assembly 600. Examples of such keys are described in detail, for example, in the '981 patent referred to above. For example, the electronic key 650 may have an electrical induction and/or capacitive mechanism for operating the key-lock combination. When the electronic key 650 engages with the lock assembly 600, certain mechanical operations can occur and certain electrical operations can occur. When engaging the electronic key 650 with the lock assembly 600, the electronic key 650 can be rotationally positioned relative to the lock assembly 600 such that tabs of the electronic key 650 are aligned with corresponding slots of the lock assembly 600 (for example, the slots between the tabs 1470 in FIG. 11). The electronic key 650 may be displaced axially such that the tabs pass through the slots and a cylindrical portion of the electronic key 650 is positioned within a housing of the lock assembly 600. The electronic key 650 can be sized and shaped such that the tabs fit through an opening in the lock assembly 600 fluid guard 400. In this relative position, the electronic key 650 is able to rotate within the housing and the fluid guard 400.

In certain embodiments, when the electronic key 650 engages the lock assembly 600 there are two transfers that occur. The first transfer can be a transfer of power and the second transfer can be a transfer of data. The electronic key 650 may include a partial capacitor comprising a capacitive metal plate in communication with a processor. The capacitive metal plate of the partial capacitor can form a capacitor with a corresponding capacitive metal plate of a lock when brought into proximity with the metal plate of the lock, thereby allowing for capacitive data or power transfer between the key and lock (see FIGS. 10-12). This capacitive data communication can allow for the release of the shackle 608.

As discussed above, however, fluid can interfere with the capacitive functionality described. For example, fluid that interferes with an electronic communication between the lock and the key may hinder the functionality of the key, for example, by altering a capacitance formed between the lock and the key capacitive plates. The fluid guard 400 and fluid absorber 500 can ameliorate this type of problem, among others.

Figure 3:
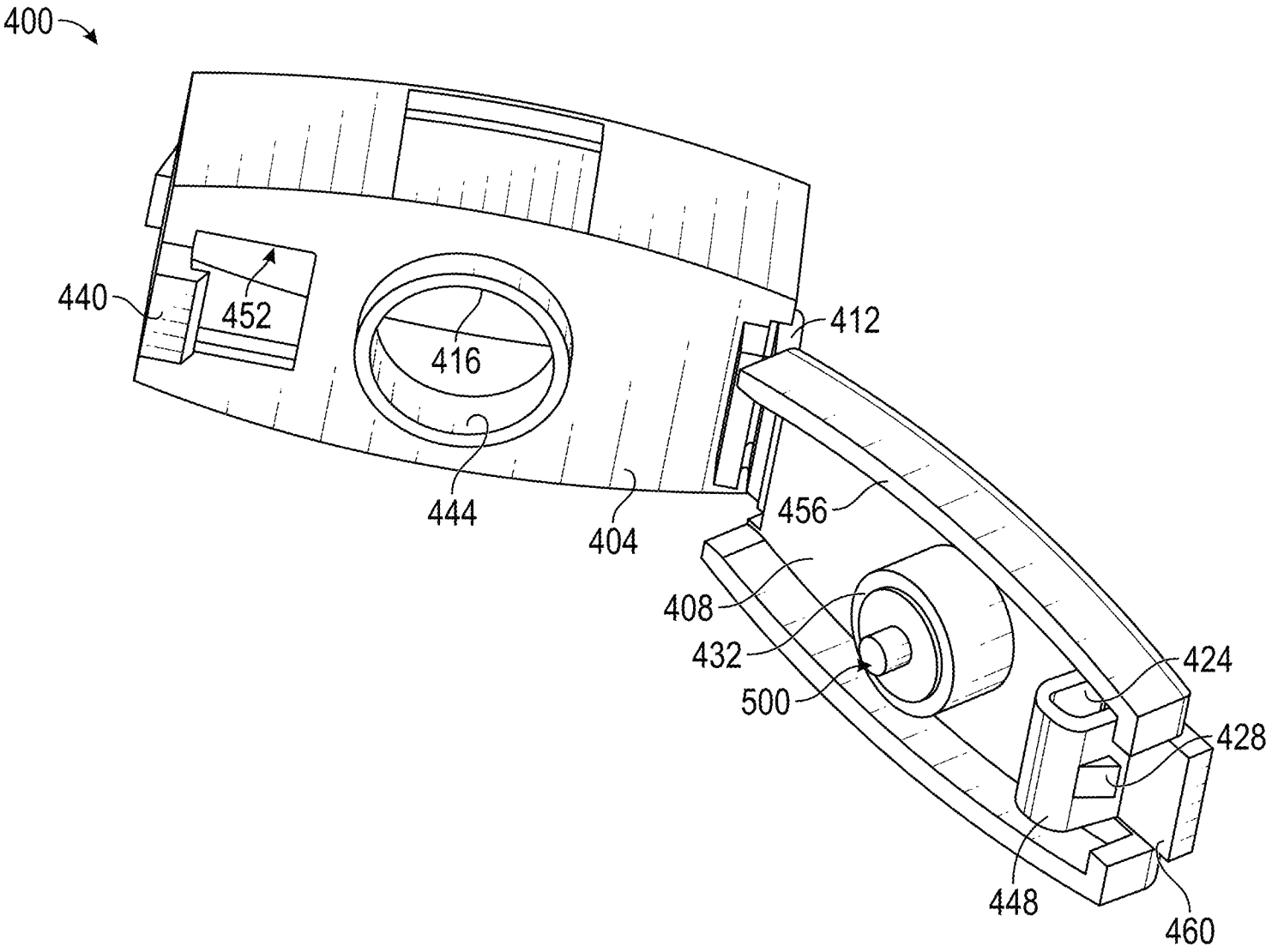
FIG. 3 shows a fluid guard that may be used in a locking assembly.

FIG. 3 shows a more detailed example fluid guard 400 that can be installed on a locking device, such as a mechanical or electronic locking device. The fluid guard 400 together with the fluid absorber 500 can block fluids and/or remove or attenuate fluid interaction with the lock face 612 (FIG. 1B).

As shown, the fluid guard 400 is in an open position. The fluid guard 400 can include a guard body 404 and a corresponding guard head 408. As shown, for example, the fluid guard 400 may be generally elongate such that a length of the guard body 404 is greater than a width of the guard body 404. In this way, the length may be measured along a major axis and/or the width be measured along a minor axis of the guard body 404. However, the guard body 404 and guard head 408 may be square, oval, round, or otherwise differently shaped than shown here.

One or more sides of the guard body 404 may be rounded, as shown in FIG. 3. A hinge 412 can connect the guard body 404 and the guard head 408. In some embodiments, the hinge 412 defines an axis substantially perpendicular to a direction of insertion of a key (for example, the electronic key 650) and/or parallel to the minor axis. However, in other embodiments, the hinge axis may be parallel to the major axis.

To close the fluid guard 400, a fastening mechanism 428 on the guard head 408 can mate with (for example, be inserted into, snap fit with, friction fit with, or the like) a corresponding fastening receiver 440. The fastening mechanism 428 can include a cantilevered portion or other ledge (for example, sloped ledge), as shown. The fastening mechanism 428 may be an extension of another portion of the guard head 408, such as a fastening body 448, as shown. The fastening mechanism 428 can have a snap fit with the fastening receiver 440. The fastening receiver 440 can include a cantilevered portion or other type of ledge. In some embodiments, the fastening receiver 440 may include a slot in a portion of the guard body 404. The fastening receiver 440 may be attached to an extension from a surface of the guard body 404, as shown.

Other mechanisms can be used to close the fluid guard 400. For instance, the guard head 408 may be closed using a friction fit. Additionally or alternatively, a latch mechanism may be used to close the guard head 408. In some embodiments, a magnet may be inserted into the fluid absorber 500 and/or the guard head 408. A magnetic element (for example, a magnet) may be inserted in the guard body 404 to which the magnet may be attracted. This configuration can be used to encourage the guard head 408 to remain in a closed position.

One or more components of the fluid guard 400 may include a resilient material. The resilient material may include, for example, a synthetic material such as a synthetic polymer (for example, a synthetic elastomer, a synthetic plastic, etc.). For example, the resilient material of the fluid guard 400 may comprise silicone. Additionally or alternatively, the resilient material may include a natural material, such as a polymer of organic compound(s). The material of the fluid guard 400 can have a durometer of between about 10 and 50. In some embodiments, the durometer may be between about 20 and 40. Preferably, the durometer may be between about 25 and 35. For example, the durometer may be about 30 in certain embodiments. A durometer in one of these ranges may be soft enough to enable an interference fit or friction fit between the guard head and the guard body so as to further resist fluid entry.

The fastening mechanism 428 may be disposed near a distal end of the guard head 408. Distal and proximal may refer to relationships to the hinge 412. Similarly, the fastening receiver 440 may be located at or near a distal end of the guard body 404, as shown. The fastening body 448 may include a protrusion from the guard head 408. A corresponding slot 452 may be in the guard body 404. The slot 452 may be configured to receive the fastening body 448 and/or the fastening mechanism 428. The slot 452 may include an opening within the guard body 404.

In some embodiments, such as the one shown in FIG. 3, the fastening body 448 may include an air outlet 424. The air outlet 424 may be configured to be in fluid communication with a cup portion of the lock assembly 600, for example. The cup portion may be where the lock assembly 600 comes in contact with the key (for example, electronic key 650). Accordingly, the air outlet 424 can provide an air access with the environment. This air access can promote the evaporation or otherwise removal of any accumulated fluid in or around the fluid guard 400. The air outlet 424 may define an air flow axis along which air may enter and/or exit. The air flow axis may be parallel to the hinge axis and/or perpendicular to the major axis of the lock assembly 600.

The guard head 408 may include one or more sidewalls 456. The sidewalls 456 can create a fluid seal along one or more sides of the fluid guard 400. The one or more sidewalls 456 can wick fluid away from the aperture 416 and/or guide fluid along a length of the sidewalls 456. This wicking or guiding action may help fluid to avoid entering between the guard body 404 and the guard head 408. The sidewalls 456 may be disposed approximately parallel to a major axis of the fluid guard 400. In some embodiments, the sidewalls 456 may be curved (for example, to align with the guard body 404). Other orientations and shapes are possible. For example, the sidewalls 456 may be disposed on the guard body 404 in some embodiments.

The example guard body 404 shown includes an aperture 416. The aperture 416 may allow insertion of a key (for example, the electronic key 650) therethrough. The aperture 416 can be aligned approximately centrally within the guard body 404 (for example, at an intersection of the major and minor axes of the guard body 404). In some embodiments, the aperture 416 is approximately circular, though other shapes (for example, rectangular, elliptical, etc.) are possible. The aperture 416 may be surrounded at least in part or in full by a rim 444, as shown. The rim 444 may be a raised portion relative to a surface of the guard body 404, thereby further protecting a lock face 612 (see FIG. 1B) from fluid entry.

The rim 444 may be configured to receive a connector frame 432 disposed on the guard head 408. The connector frame 432 can be a raised portion relative to a surface of the guard head 408. For example, the connector frame 432 may include a raised rim that fits within the rim 444 and/or the aperture 416. The raised rim of the frame 432 may have a circular perimeter or circular cross section, although other shapes are possible (such as oval, square, and rectangular). The raised rim may have an internal perimeter that is circular or some other shape. The internal perimeter may be a portion of the frame 432 that contacts the fluid absorber 500 and that at least partially holds the fluid absorber 500 in place. The connector frame 432 may have a friction fit with the rim 444 to further protect the lock face 612 (see FIG. 1B) from fluid entry.

The connector frame 432 can house the fluid absorber 500. The fluid absorber 500 can advantageously absorb or otherwise wick away fluids from the lock face 612 (see FIG. 1B), to prevent or reduce fluids from interfering with capacitive communications between the lock and a key (see FIG. 2). The fluid absorber 500 is described in greater detail below with respect to FIG. 5. Near a distal end of the guard head 408, an extension 460 may be provided to aid a user in opening the guard head 408.

Figure 4:
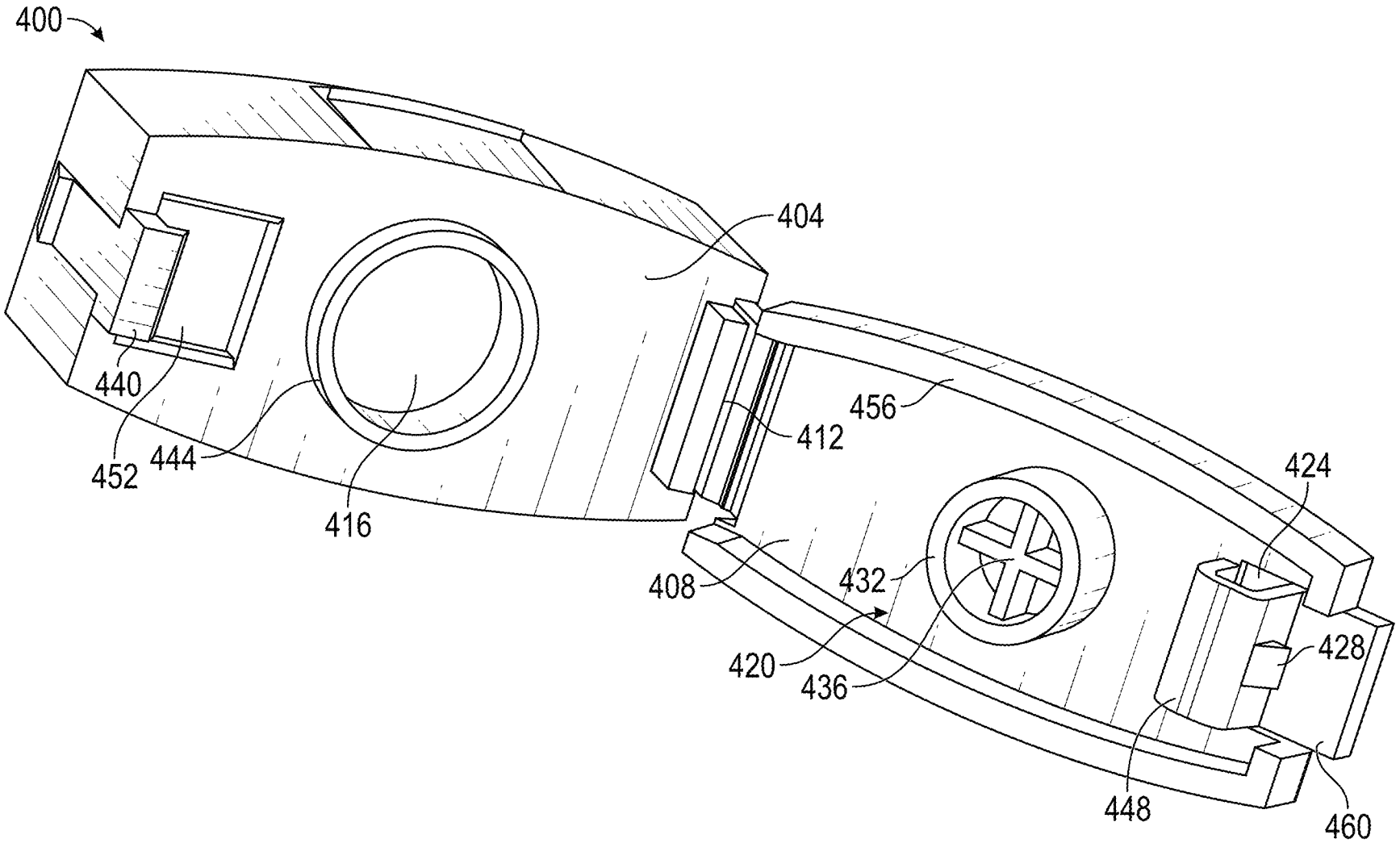
FIG. 4 shows a fluid guard without a fluid absorber.

FIG. 4 shows the example open fluid guard 400 of FIG. 3 without the fluid absorber 500. A support 436 is shown. The support 436 may be a raised portion from a surface of the guard head 408. The support 436 may be configured to support a fluid absorber 500 (not shown in FIG. 4). The support 436 may include an adhesive or other material configured to encourage the fluid absorber 500 to remain within the connector frame 432.

Example Fluid Absorber

Figure 5:
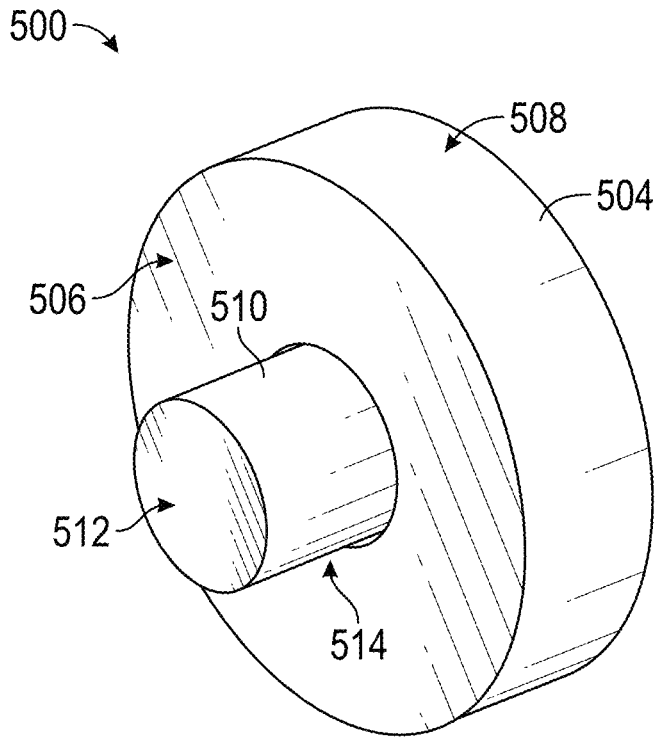
FIG. 5 shows a perspective view of a front of an example fluid absorber.

FIG. 5 illustrates the example fluid absorber 500 described above in more detail. The example fluid absorber 500 shown includes a protruding portion 510 and an annular portion 504. The fluid absorber 500 can, but need not, exhibit axial symmetry about an absorber axis. The absorber axis may be parallel to the direction of insertion of a key (for example, the electronic key 650). The annular portion 504 may be configured to surround a portion of the protruding portion 510. The protruding portion 510 may include a proximal surface 512 and a peripheral surface 514. The annular portion 504 may surround a portion of the protruding portion 510 along a peripheral surface 514. The annular portion 504 may similarly include a proximal surface 506 and a peripheral surface 508. The proximal surface 506 of the annular portion 504 may be approximately parallel to the proximal surface 512 of the protruding portion 510. One or more of the peripheral surface 514 and/or the peripheral surface 508 may be disposed parallel to the absorber axis.

The proximal surface 512 of the protruding portion 510 may be spaced less than an inch from the proximal surface 506 of the annular portion 504. In some embodiments, the distance between the proximal surfaces 506, 512 may be about ¼ inch. The annular portion 504 may have a height of between about 1/32 inch and ½ inch. In some embodiments, the height of the annular portion 504 is about ⅛ inch. The protruding portion 510 may have a height of between about 1/16 inch and ¾ inch. In some embodiments, the height of the protruding portion 510 is about ¼ inch. The The annular portion 504 and the protruding portion 510 may be two separate elements, as shown. However, in some embodiments, the annular portion 504 and the protruding portion 510 together form a single element. In embodiments, where they are separate elements, the protruding portion 510 may be inserted into the annular portion 504 using one or more types of interfaces. For example, the interface may be a friction fit and/or an adhesive attachment.

When the guard head 408 is brought into contact with or proximity to the guard body 404, the protruding portion 510 of the fluid absorber 500 can mate with (for example, be inserted into, snap fit with, friction fit with, or the like) a receptacle (for example, an interior cup) of a portion of the lock core, such as the lock face 612, while the annular portion 504 can contact and/or protect an exterior annulus of a portion of the lock core (for example, the lock face 612). For example, with respect to FIG. 11 (discussed in greater detail below) the protruding portion 510 may be inserted into a cup 1452 of the lock face 612 while the annular portion 504 can contact the annulus surrounding the cup 1452 (and optionally cover all or substantially all of the lock face surrounding the cup 1452). When the fluid absorber 500 contacts the lock face 612, fluid can be absorbed and/or wicked away. Further, the proximal surface 512 of the protruding portion 510 may interface with a bottom of the cup portion of the lock assembly 600 (for example, the cup 1452 in FIG. 11). The guard head 408 may bring the fluid absorber 500 into contact with or at least in proximity to a portion of the lock, such as the lock face 612. For example, the guard head 408 can bring the fluid absorber 500 within a short distance of the lock face 612, such as within less than 0.1 mm, 0.2 mm, 0.5 mm, 0.75 mm, 1 mm, or 2 mm (or any value therebetween) of the lock face 612. Even in situations where the fluid absorber 500 is in proximity to the lock face 612 and not in strict contact, the fluid absorber 500 can still be effective at wicking away and/or absorbing fluid disposed on the lock face 612.

Because the example fluid absorber 500 is shaped to enter the interior cup of the lock face and/or contact or come into proximity to the exterior of the lock face, the fluid absorber 500 can contact and/or protect a significant portion of the surface of the lock face. As a result, the fluid absorber 500 can be very effective at wicking away or absorbing water from many or all surfaces of the lock face.

In other embodiments, the fluid absorber may be shaped differently. The shape of the fluid absorber may conform more fully to the lock face, including by having any ridges, valleys, or protrusions needed to conform to the shape of the lock face. Other example fluid absorbers may not have the protrusion 510 but instead may be a flat or substantially flat disk. For example, with some electronic locks that use electrical contacts instead of capacitive or inductive coupling, a flatter surface fluid absorber may be used.

The fluid absorber 500 can include an antibacterial element. For example, the fluid absorber 500 can include an antimicrobial agent that is configured to destroy microbes that may be present in the fluid. This benefit may further prolong the life of the lock assembly 600 and/or the electronic key 650. For example, the fluid absorber 500 can include a compound including silver or another antimicrobial element or compound.

The material of the fluid absorber 500 can be a foam or foam-like material for fluid absorption purposes. For example, the material may comprise polyvinyl alcohol (PVA) and/or polyurethane (PUR). The material may include small (for example, on the order of microns) pockets of air configured to promote absorption of liquid. For example, the material may be a closed-celled foam or open-celled foam, but a closed-cell foam is preferable in some embodiments because it may draw water away from the lock face 612 without retaining water like an open-celled foam. The material may be configured to absorb between about 5 and 15 times its weight in fluid. In some embodiments, the material can absorb between about 9 and 13 times its weight in fluid. For example, the material may be configured to absorb about 12 times its weight in fluid. In some embodiments, the material is configured to absorb at least 3 times its weight in fluid.

Figure 6:
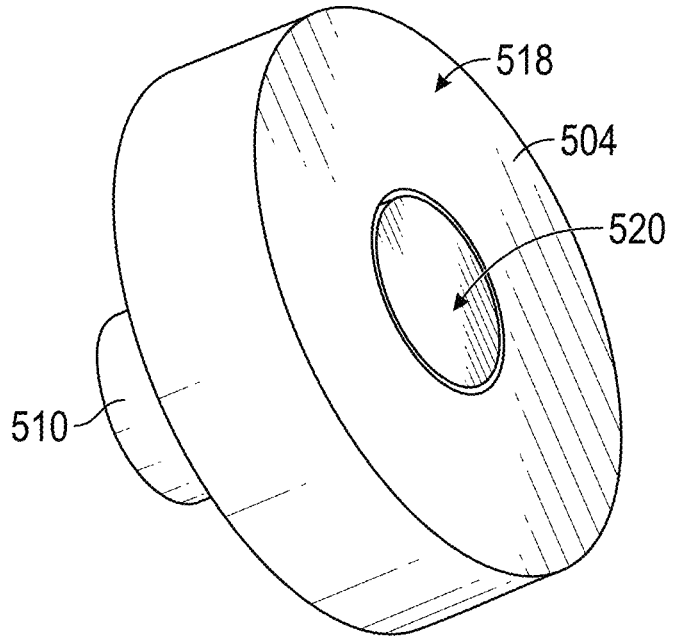
FIG. 6 shows a perspective view of a back of the example fluid absorber of FIG. 5.

FIG. 6 illustrates a back view of the example fluid absorber 500 shown in FIG. 5. A distal surface 518 of the annular portion 504 may be approximately coplanar with a distal surface 520 of the protruding portion 510. As mentioned herein, the protruding portion 510 and the annular portion 504 may be formed as a single element. For example, they may be machined or molded as a single element. The protruding portion 510 and the annular portion 504 may be adhered or otherwise affixed to the support 436. More generally, the fluid absorber, in any of its forms described herein, may be formed from a single piece of material or multiple (for example, two or more) pieces of material.

Figure 7:
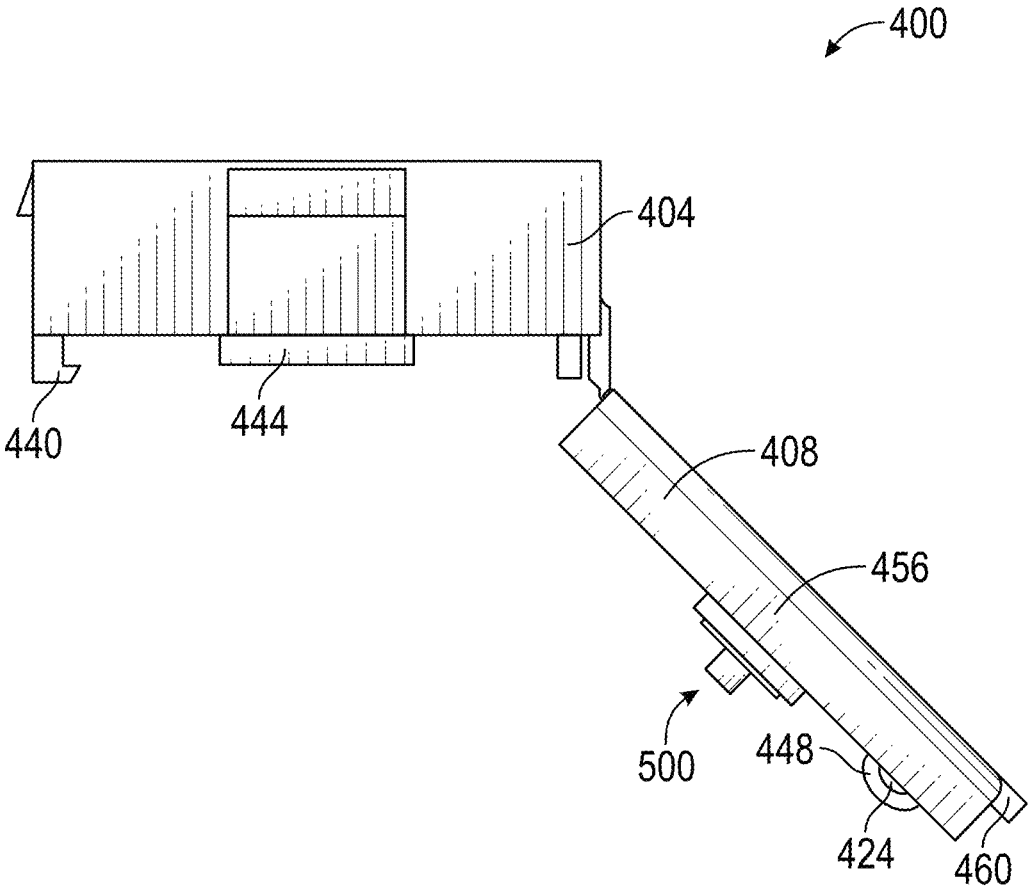
FIG. 7 shows a side view of an example fluid guard with an example fluid absorber.
Figure 8:
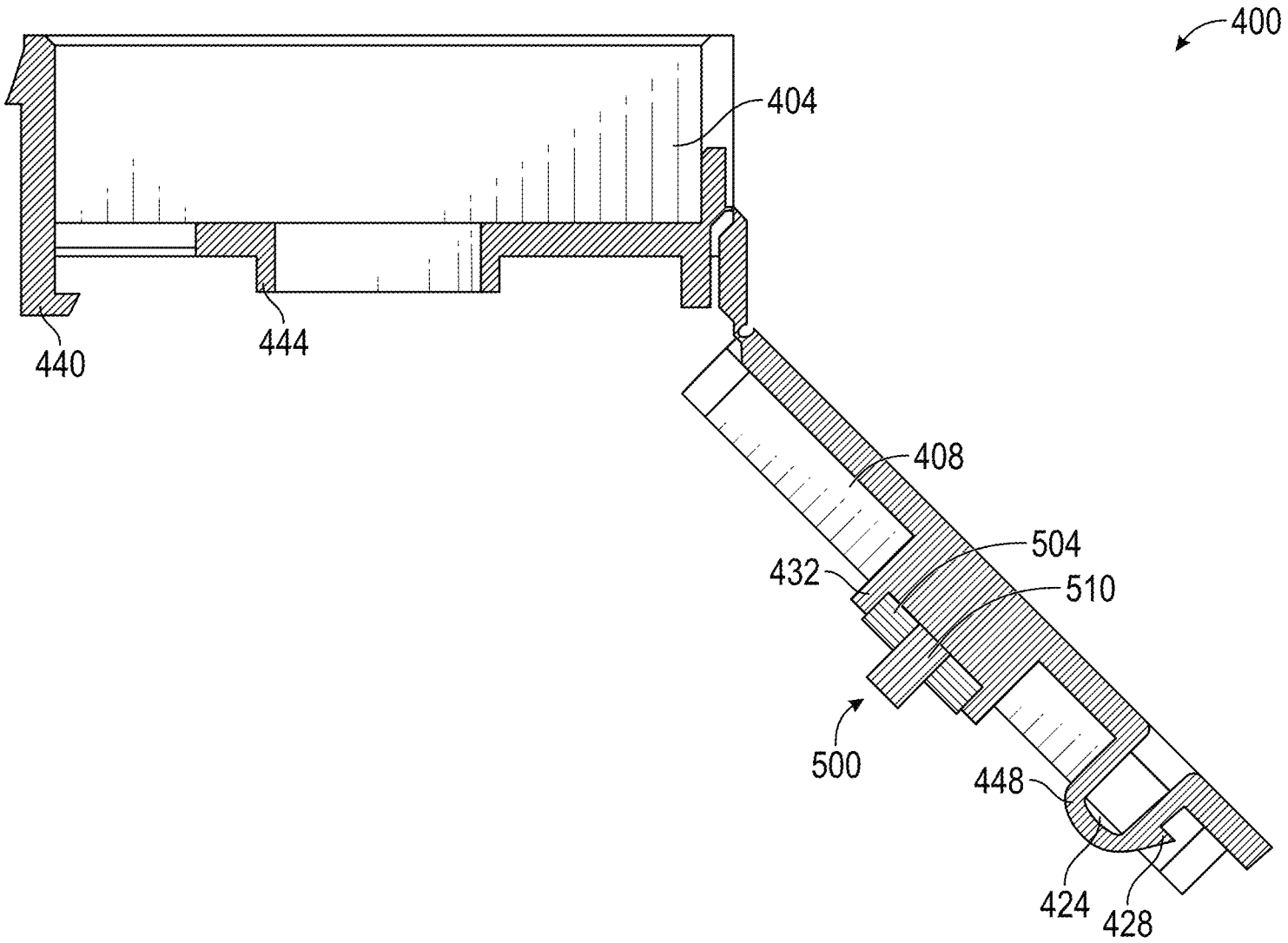
FIG. 8 shows a side view of a cross-section of the example fluid guard in FIG. 7.
Figure 9:
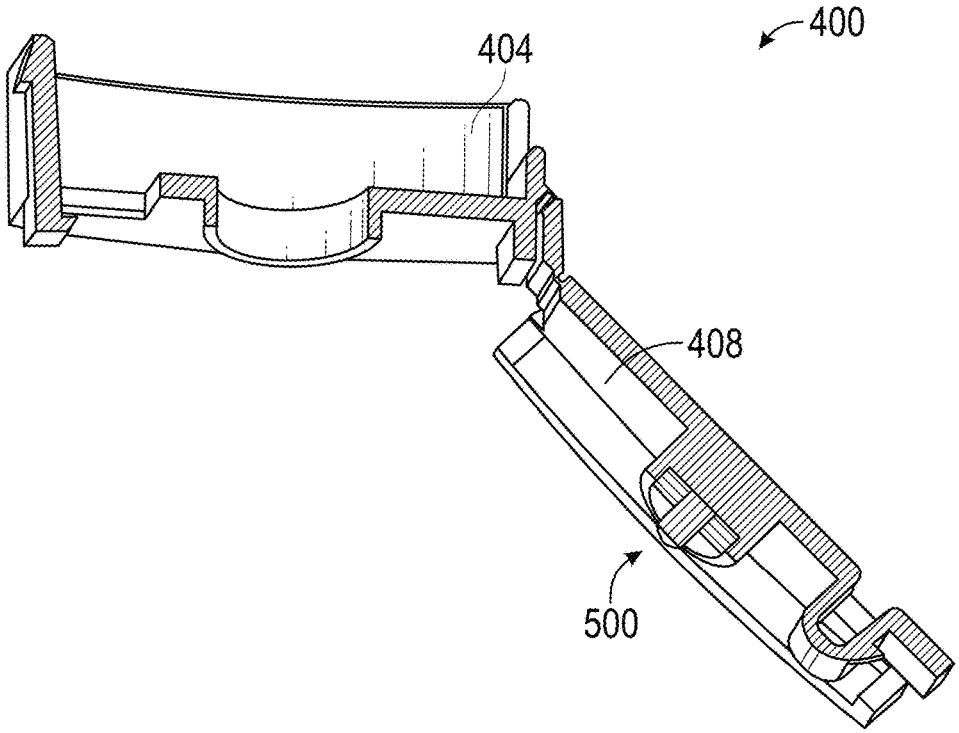
FIG. 9 shows a perspective view of the cross-section of FIG. 8.

FIG. 7 a side view of the example fluid guard 400 shown in FIGS. 3-4 including the fluid absorber 500 shown in FIGS. 5-6. FIG. 8 shows a side cross-section view of the fluid guard in FIG. 7 with a cross section along the major axis of the guard body 404 and the guard head 408. FIG. 9 shows a perspective view of the cross-section of FIG. 8.

Figure 10:
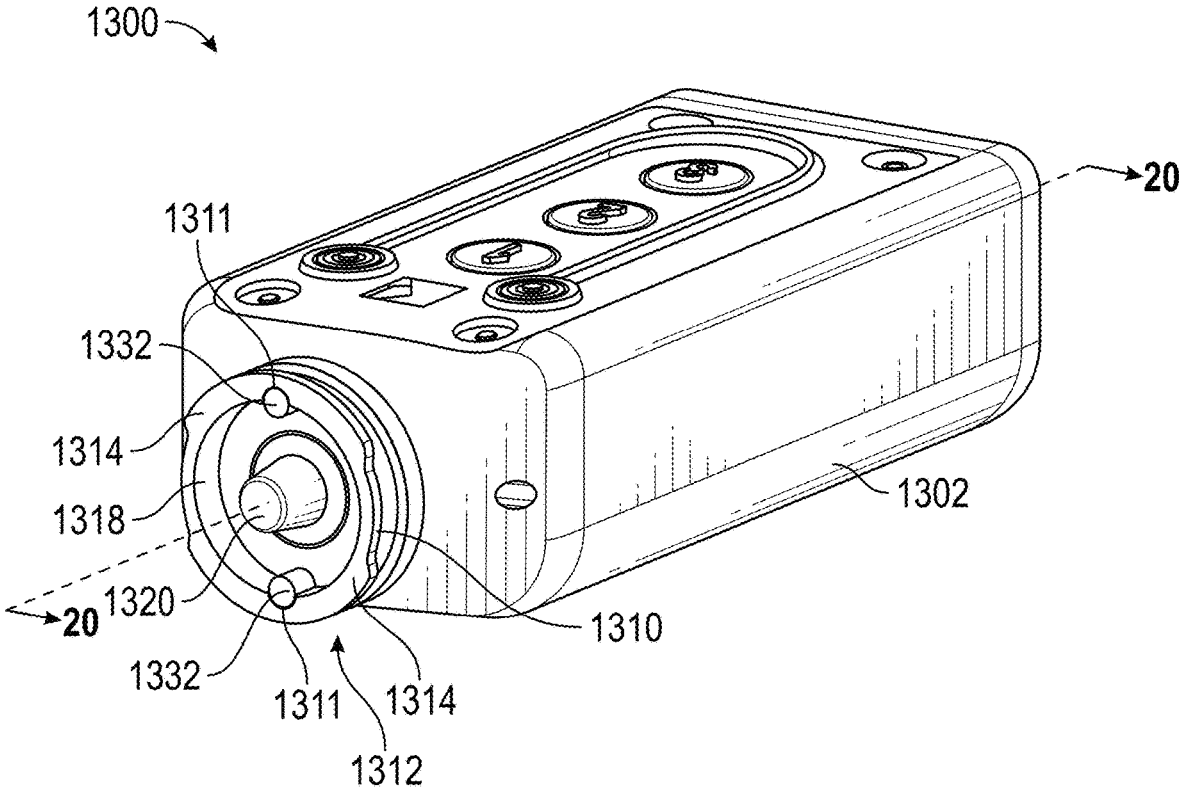
FIG. 10 illustrates a perspective view of an example embodiment of a key having shear pins.

FIG. 10 illustrates an embodiment of a key 1300 having shear pins 1332. The key may include some or all of the features of the electronic key 650 described above with reference to FIG. 2. The key 1300 can be used, for example, to mate with the electronic lock face 612 described above.

The key 1300 includes an elongate main body portion 1302 that is generally rectangular in cross-sectional shape. The illustrated key 1300 also includes a mating portion 1312 of smaller external dimensions than the body portion 1302. The body portion 1302 can house the internal electronics of the key 1300 as well as other components. The mating portion 1312 can engage a lock described below with respect to FIG. 11. The mating portion 1312 includes a cylindrical portion 1310 that houses a power coil 1320 and a capacitive data portion or data coil (not shown). On the outer surface of the cylindrical portion are two tabs 1314 which can rotationally engage the key 1300 relative to the lock (see FIG. 11). These tabs 1314 extend radially outward from the outer surface of the cylindrical portion 1310 and oppose one another.

Figure 11:
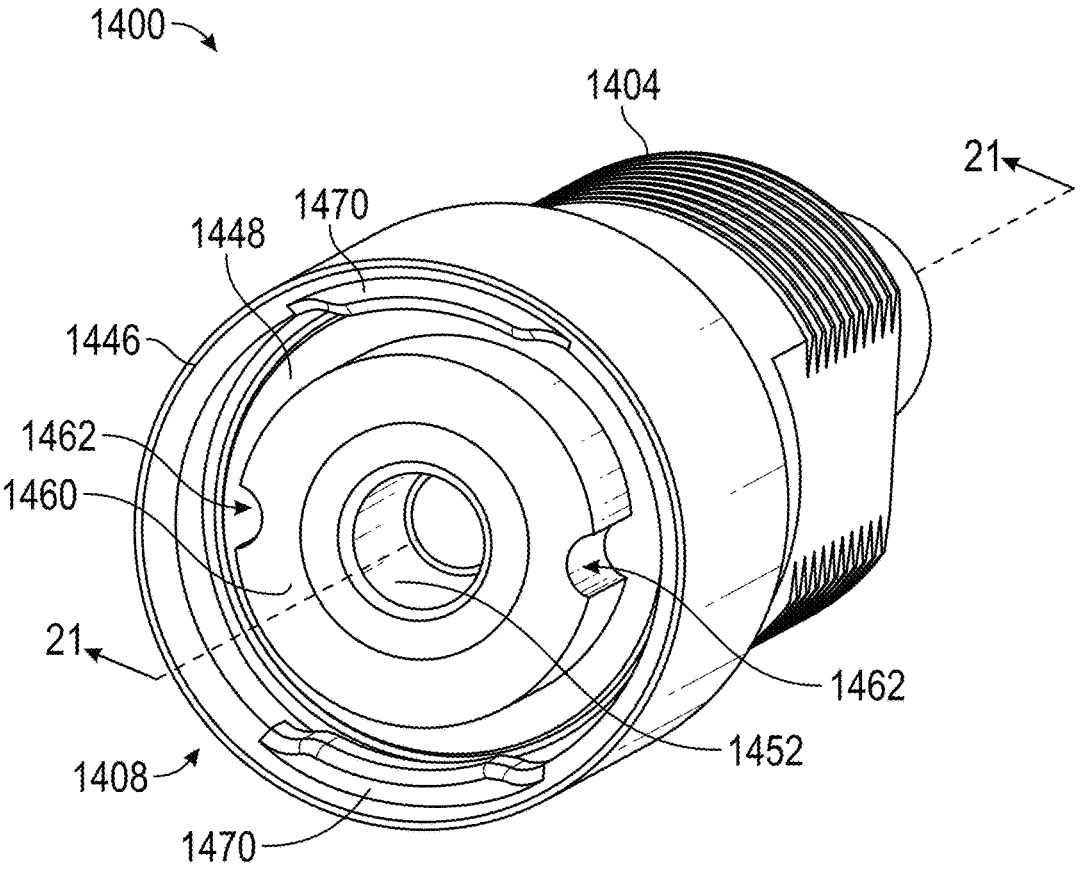
FIG. 11 depicts an embodiment of an example lock.

FIG. 11 depicts an embodiment of an electronic lock core 1400. The electronic lock core 1400 may include some or all of the features of a lock core described above with reference to the lock assembly 600 of FIGS. 1A-2. A face of the electronic lock core 1400 may correspond to the lock face 612 in FIG. 1B.

The electronic lock core 1400 includes a body portion 1404 and a mating portion 1408. The body portion 1404 may at least partly house one of the coil assemblies described above. The diameter of the mating portion 1408 is larger than the diameter of the body portion 1404. The mating portion 1408 includes a cylinder 1446 and a raised cylindrical portion 1460 disposed within the cylinder 1446. An annular groove 1448 or key recess is formed between the cylinder 1446 and the raised cylindrical portion 1460. The annular groove 1448 is capable of receiving the tabs 1314 of the key 1300. A cup 1452 is disposed within the raised cylindrical portion 1460, which is capable of receiving the power coil 1320 of the key 1300 as well as the protruding portion of the fluid absorber described above.

In certain implementations, the key 1300 may mate with the electronic lock core 1400 by placement of the tabs 1314 in the annular groove 1448, by placement of the power coil 1320 in the cup 1452. The key 1300 may provide data to the electronic lock core 1400, optionally after a user presses a certain button sequence on the key 1300, allowing a locking mechanism of the electronic lock core 1400 to be actuated. The key 1300 may then be turned by an operator of the key to unlock the lock. Locking may proceed, for example, by turning the key 1300 in a reverse motion.

Figure 12:
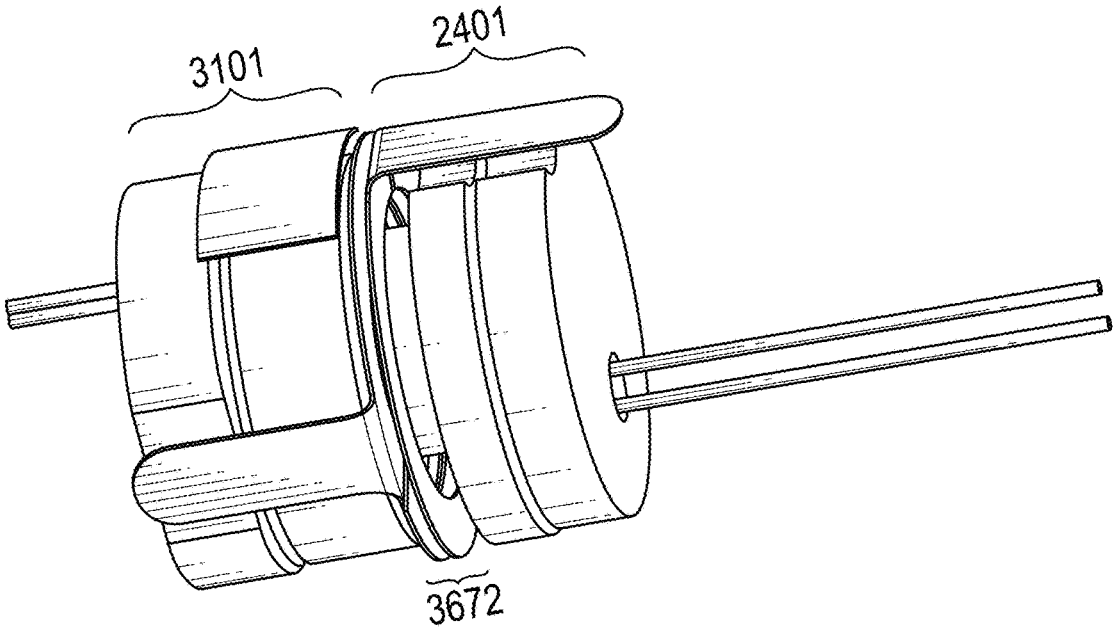
FIG. 12 illustrates a perspective view of internal components of an example embodiment of a key/lock engagement assembly.

FIG. 12 illustrates example internal components of the key and lock described with respect to FIGS. 10 and 11. This figure illustrates how partial capacitors of a cup assembly 3101 and nose assembly 2401 of the lock and key, respectively, may be engaged in order to produce a two-plate capacitor 3672. The outer housings of the respective components are omitted for illustrative purposes only. Although not shown, the partial capacitors of the key and lock assemblies may be covered by a dielectric layer, such as a plastic, for example. The plastic or other material may provide a dielectric effect between the capacitor plates, thereby potentially increasing the capacitance of the capacitor 3672.

As described above, fluid that accumulates between the partial capacitors can change the capacitance undesirably. Thus, the fluid absorber 500 may be inserted into the cup assembly 3101. In this way, the fluid absorber 500 can wick away and/or absorb fluid therein to reduce or eliminate changes to the capacitance of the capacitor 3672.

Example Lock Box Fluid Guard

Figure 13A:
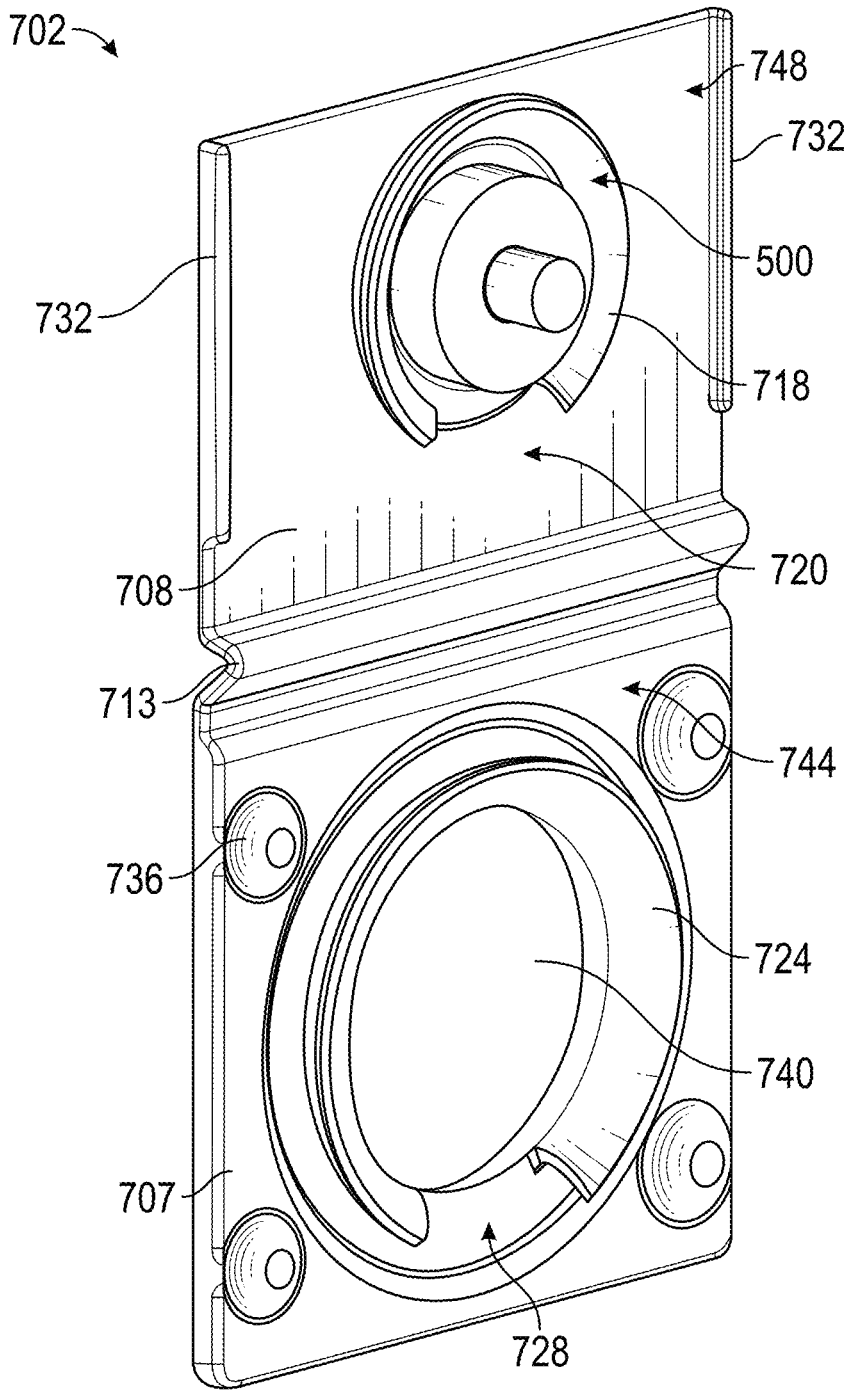
FIG. 13A shows a front side of an example fluid guard that may be used, for example, on a locking device of a storage container (for example, a lock box).

FIG. 13A shows a front side of an example fluid guard 702 that may be used, for example, on a locking device of a storage container, door, or other locked item. The storage container may be configured to secure supplies usable by a public service department or first responders (for example, fire department, police department, ambulance service, etc.). Additionally or alternatively, the fluid guard 702 can be used on a commercial or home lock box that holds one or more keys for emergency personnel. Frequently, emergency personnel require urgent or immediate access into a building or facility. A key in the possession of the service department may be used to unlock the storage container or lock box located or affixed at the site where urgent access is needed. For example, firefighters may need access to supplies located in a building at the scene of the fire. The box may contain a key to the building and/or necessary gear used for entry into the building and/or for fighting the fire.

The storage container or lock box may also be mounted in a clinical facility or emergency vehicle (such as an ambulance) in order to store controlled substances. Moreover, the lock box may be used in any suitable application where security and tracking access to the lock box is useful, including, for example, as evidence lockers in police stations or police vehicles. The box may additionally or alternatively hold critical medical supplies or other equipment for saving lives.

Because time is often of the essence in many lock box applications, including emergencies, emergency personnel need confidence that the locking mechanism in the lock box can be reliably trusted. An electronic lock can be used to provide greater security and audit tracking ability with a lock box, such as the electronic lock described above. For electronic locks, as described above, water may interfere with the signal generated between the key and the locking mechanism. Advantageously, for at least this reason, the lock box can be outfitted with a fluid guard as described herein.

The fluid guard 702 can have a guard base 707 and a guard door 708 connected by a hinge 713. The guard door 708 can include a fluid absorber 500, as described in more detail herein. The guard base 707 and/or the guard door 708 may be substantially flat. For example, in some lock boxes, the fluid guard 702 may need to be adhered to a flat surface. The guard base 707 can have a front surface 744 and a back surface 752 (not shown in FIG. 13A). Similarly, the guard door 708 can have a front surface 748 and a back surface 756 (not shown in FIG. 13A). The hinge 713 can be a folded hinge as shown, though other configurations are possible. The hinge 713 can allow for stretching during opening and/or closing the guard door 708. The hinge 713 may be formed of a single piece (for example, molded), thus preventing fluid that may have accumulated on the guard door 708 from being poured into the lock area (for example, the lock face). The hinge 713 can define an open position and a closed position of the fluid guard 702.

The guard base 707 includes an aperture 740. When the fluid guard 702 is in the closed position, the fluid absorber 500 may be disposed at least partially within the aperture 740. The aperture 740 can allow access to the locking mechanism (for example, at a face of the lock). The aperture 740 may allow insertion of a key (for example, the electronic key 650) therethrough. The aperture 740 can be aligned approximately centrally within the guard base 707. In some embodiments, the aperture 740 is approximately circular, though other shapes (for example, rectangular, elliptical, etc.) are possible. The aperture 740 may be surrounded at least in part or in full by a base flange 724, as shown. As shown, the base flange 724 forms a convex profile with respect to the aperture 740. Other profile shapes are possible. The base flange 724 can be referred to as a collar, an ear, a rim, or any other name signifying a raised portion. The base flange 724 can be disposed on the front surface 744 of the guard base 707. The base flange 724 can be configured to come into contact with the guard door 708 and/or create a fluid seal therebetween when the fluid guard 702 is in the closed position.

The base flange 724 can include one or more base flange vents 728. For example, a base flange vent 728 can be disposed near a "bottom" (after assembly or attachment to the lock box) of the base flange 724. This configuration may allow fluid to drain or drip away from the lock face. The base flange vent 728 can be referred to as a guide vent. The base flange vent 728 can be configured to allow air to enter the lock area and therefore promote drying (for example, evaporation) of any fluid that may have accumulated on or near the lock face. For example, the base flange vent 728 can provide fluid communication between the lock face and an exterior of the fluid guard 702, even when the fluid guard 702 is in the closed position. The guard base 707 may also include one or more contours 736 configured to fit to the underlying lock box. For example, as shown the contours 736 can be formed to allow for underlying attachment devices (for example, bolts, screws, nails, etc.) that may be formed in the underlying lock box.

The guard door 708 can have a fluid absorber 500 and/or a door flange 718 configured to guide fluid away from the fluid absorber 500. The door flange 718 may be formed similarly to the base flange 724. For example, the door flange 718 may be curved outward with respect to the fluid absorber 500 to better wick fluid away from the fluid absorber 500. The door flange 718 can be disposed at least partially about the fluid absorber 500 as shown. For example, the door flange 718 may be disposed on the guard door 708 along a curved path (for example, circular). The door flange 718 can include a door flange vent 720 that may have one or more characteristics in common with the base flange vent 728. The base flange vent 728 can be sized to at least partially fit within the aperture 740. In some embodiments, the door flange vent 720 is disposed in substantially the same orientation as the base flange vent 728 when the fluid guard 702 is in the open position. The door flange vent 720 may be disposed in the door flange 718 such that when the fluid guard 702 is in the closed position, the door flange 718 and the base flange vent 728 are not completely or substantially aligned. This configuration of the combination of vents can help provide a greater scope (for example, 360°) of fluid protection from entering the lock face while the fluid guard 702 is in a closed position. In some embodiments, in the closed position the door flange 718 and the base flange vent 728 are not aligned at all, for example as shown in FIG. 13A.

The fluid guard 702 can include one or more fluid guides 732 that are configured to further guide fluid away from the locking device and/or the fluid absorber 500. The one or more fluid guides 732 may be disposed on the guard door 708. The fluid guides 732 may be disposed along one or more edges of the guard base 707 and/or guard door 708. The fluid guides 732 may include a flange, a lip, a rim, or other structure configured to restrict the flow of fluid in a certain direction. In some embodiments, the fluid guides 732 are configured to contact and/or create a fluid seal with a corresponding portion of the fluid guard 702. For example, as shown the fluid guides 732 may be disposed on the guard door 708 and be configured to come in contact with the guard door 708.

The guard door 708 may be closed using a friction fit. Additionally, or alternatively, a latch mechanism may be used to close the guard door 708. In some embodiments, a magnet may be inserted into the fluid absorber 500 and/or the guard door 708. A magnetic element (for example, a magnet) may be inserted in the guard base 707 to which the magnet may be attracted. This configuration can be used to encourage the guard door 708 to remain in a closed position.

One or more components of the fluid guard 702 may include a resilient material. The resilient material may include, for example, a synthetic material such as a synthetic polymer (for example, a synthetic elastomer, a synthetic plastic, etc.). For example, the resilient material of the fluid guard 702 may include silicone (for example, silicone rubber). Additionally or alternatively, the resilient material may include a natural material, such as a polymer of organic compound(s). The material of the fluid guard 702 can have a durometer of between about 10 and 50. In some embodiments, the durometer may be between about 20 and 40. Preferably, the durometer may be between about 25 and 35. For example, the durometer may be about 30 in certain embodiments. The durometer may be of Type A (for example, 20 A, 30 A, 35 A, etc.). A durometer in one of these ranges may be soft enough to enable an interference fit or friction fit between the guard head and the guard body so as to further resist fluid entry. The fluid guard 702 may be molded as a single piece. Such a soft material can help promote easier opening/closing of the guard door 708.

Because of the advanced engineering of the fluid guard 702, it may be able to operate in a wide range of temperatures. For example, it may operate down to very cold temperatures (for example, −55° F.) and/or up to very hot temperatures (for example, 450° F.). The material may be resistant to deterioration from UV rays and/or corrosion. In some embodiments, the fluid guard 702 can be configured to be opened/closed more than 100,000 times before needing to be replaced or repaired. In some embodiments, the fluid guard 702 can be sized and shaped to fit a plurality of different types of lock boxes and/or locking mechanisms. For example, the fluid guard 702 or one or more components thereof can be configured to fit a "Roman Bracket." For example, the fluid guard 702 can include a groove to align over a magnet alignment ring of the Roman Bracket. Additionally or alternatively, the fluid guard 702 can include clearance pockets to align over rivets on early brackets.

Figure 13B:
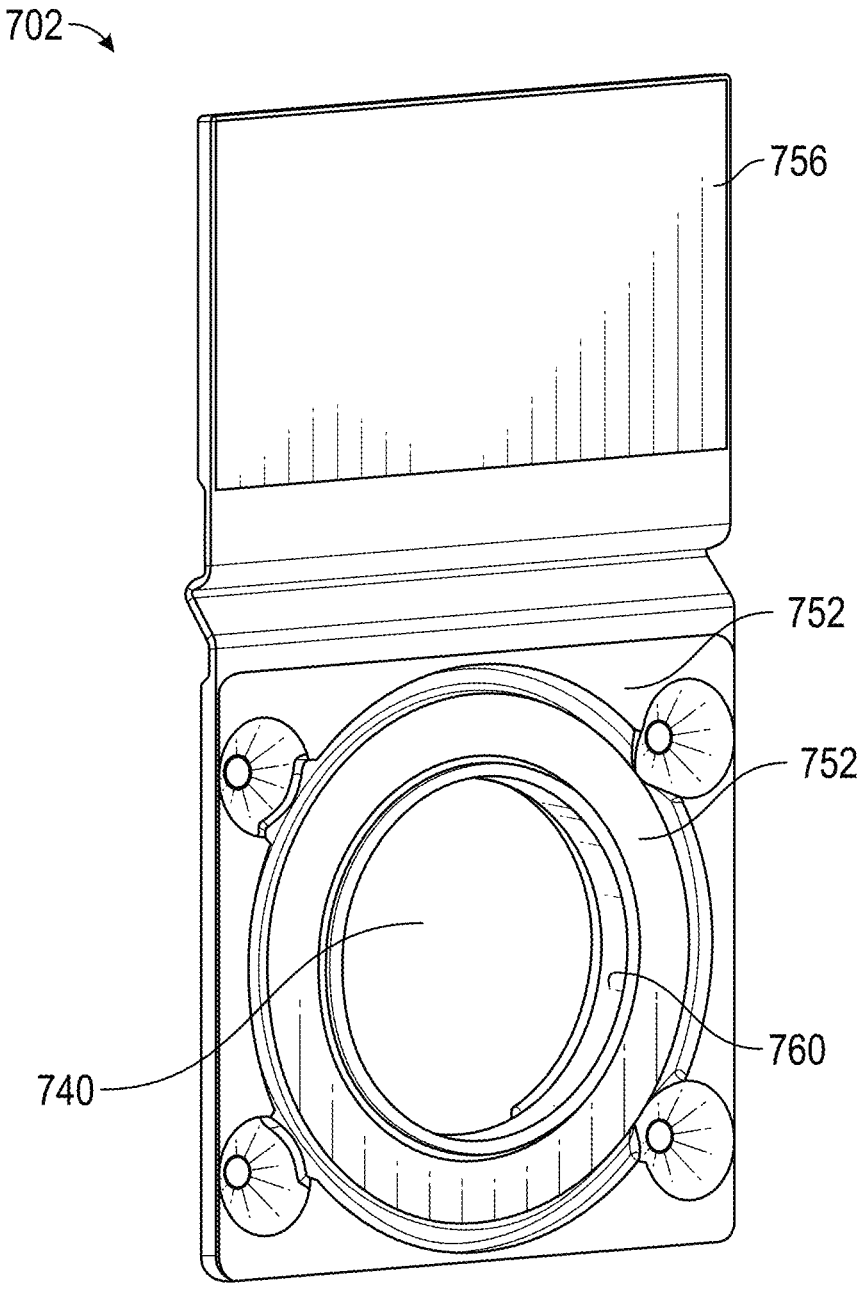
FIG. 13B shows a back side of the fluid guard of FIG. 13A.

FIG. 13B shows a back side of the fluid guard 702 in FIG. 13A. Various portions of the back surfaces 752, 756 of the fluid guard 702 may include adhesive configured to allow the fluid guard 702 to be adhered to a latch/door and body of a lock box. A base gasket 760 may be formed around at least a portion of the aperture 740. The base gasket 760 can include a lip, a flange, a rim, or other structure that allows it to create a better fit and/or seal with the lock box lock face.

Figure 13C:
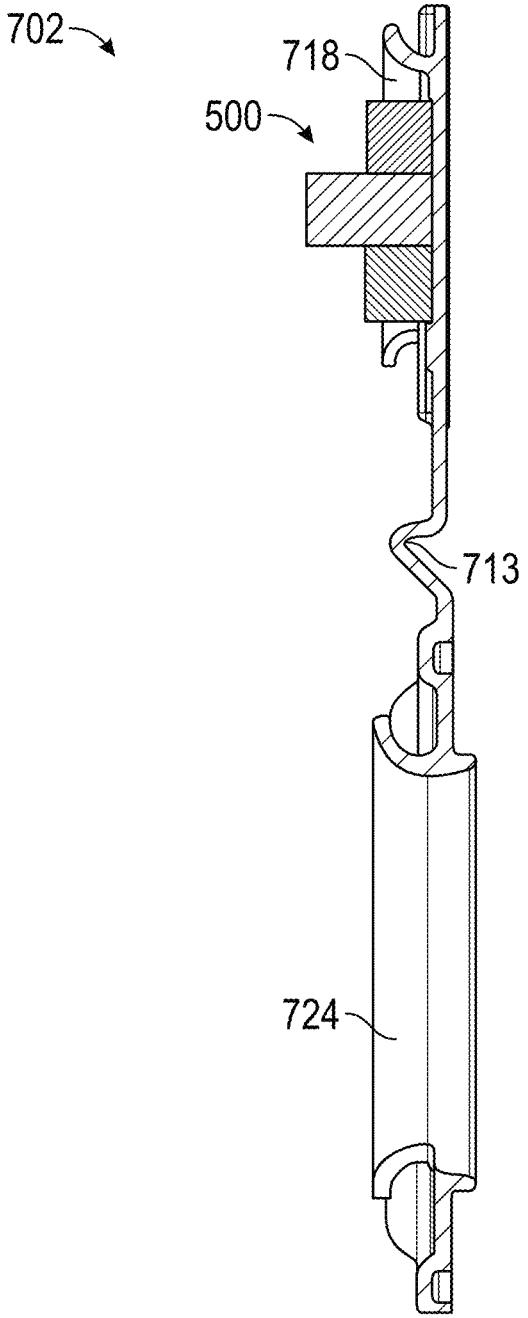
FIG. 13C shows a cross section of a side view of the example fluid guard of FIGS. 13A-B.

FIG. 13C shows a cross section of a side view of the example fluid guard 702 of FIGS. 13A-B. The profile of the door flange 718 and the base flange 724 can be clearly seen. As shown, the door flange 718 can be curved away from the fluid absorber 500 and/or the base flange 724 can be curved away from the aperture 740.

Figure 14A:
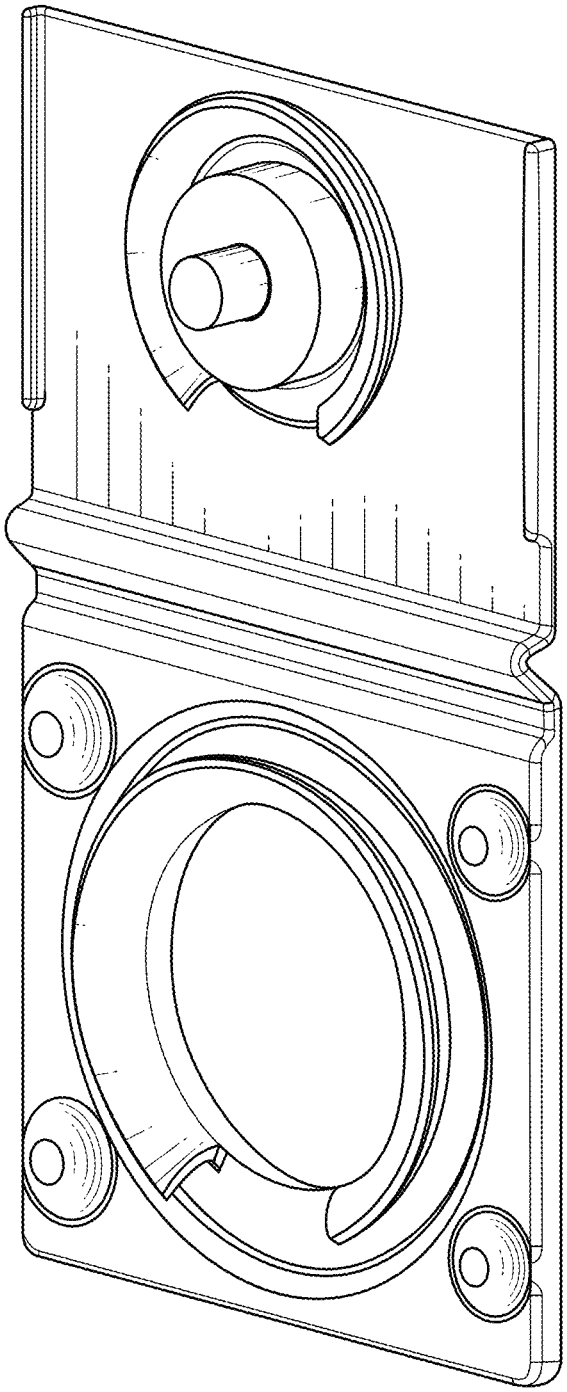
FIG. 14A shows a perspective view of a fluid guard from the front.
Figure 14B:
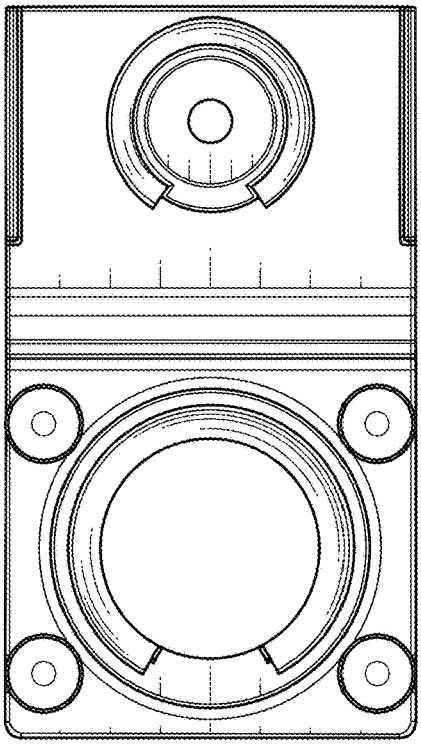
FIG. 14B shows a front view of a fluid guard.
Figure 14C:
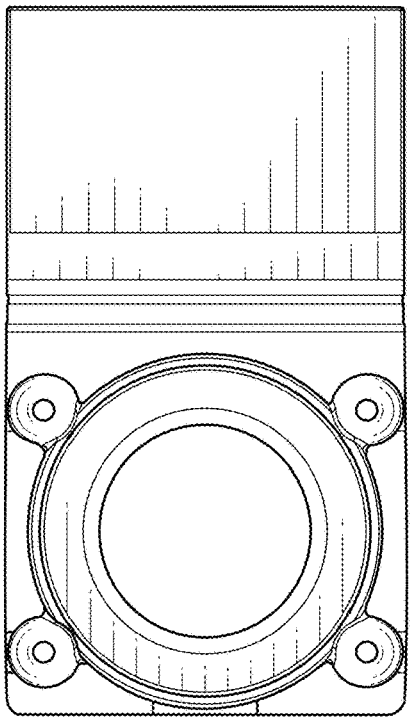
FIG. 14C shows a back view of a fluid guard.
Figure 14D:
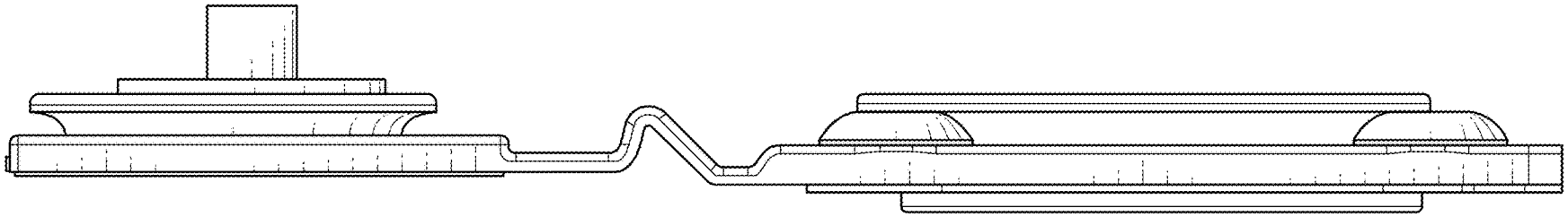
FIG. 14D shows a left side view of a fluid guard.
Figure 14E:
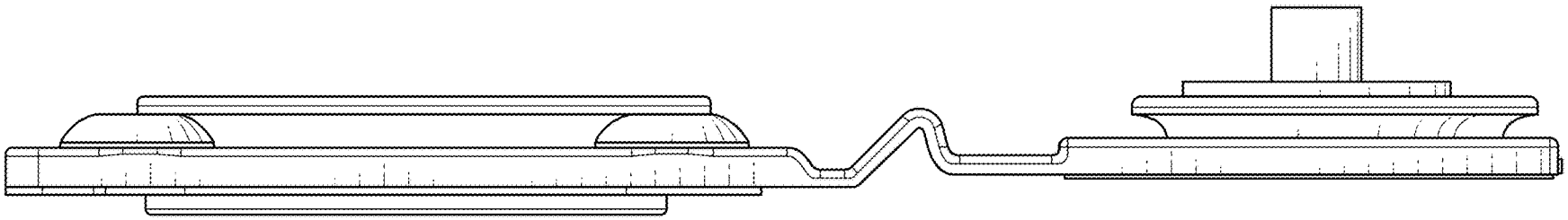
FIG. 14E shows a right side view of a fluid guard.
Figure 14F:
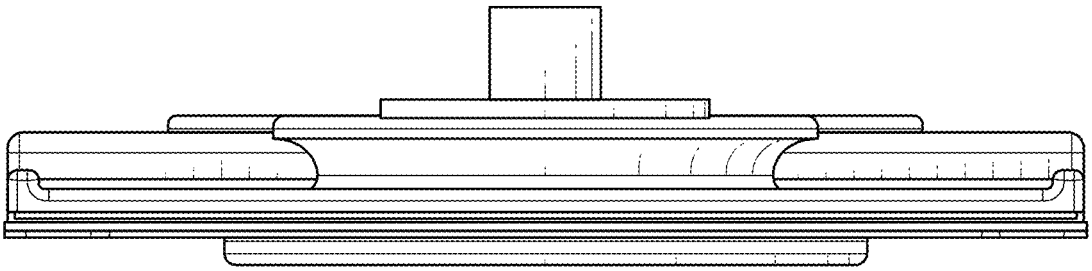
FIG. 14F shows a top view of a fluid guard.
Figure 14G:
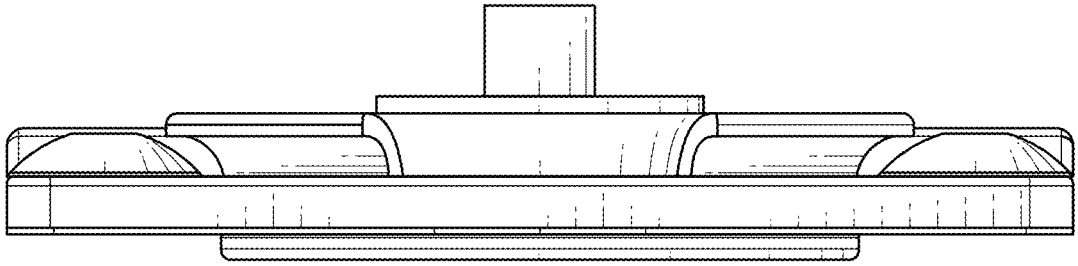
FIG. 14G shows a bottom view of a fluid guard.

FIGS. 14A-G show various views of an example fluid guard 702. FIG. 14A shows a perspective view of the fluid guard 702 from the front. FIG. 14B shows a front view of fluid guard 702 and FIG. 14C shows a back view of the fluid guard 702. FIG. 14D shows a left side view of the fluid guard 702 and FIG. 14E shows a right side view. FIG. 14F shows a top view and FIG. 14G shows a bottom view.

Figure 15:
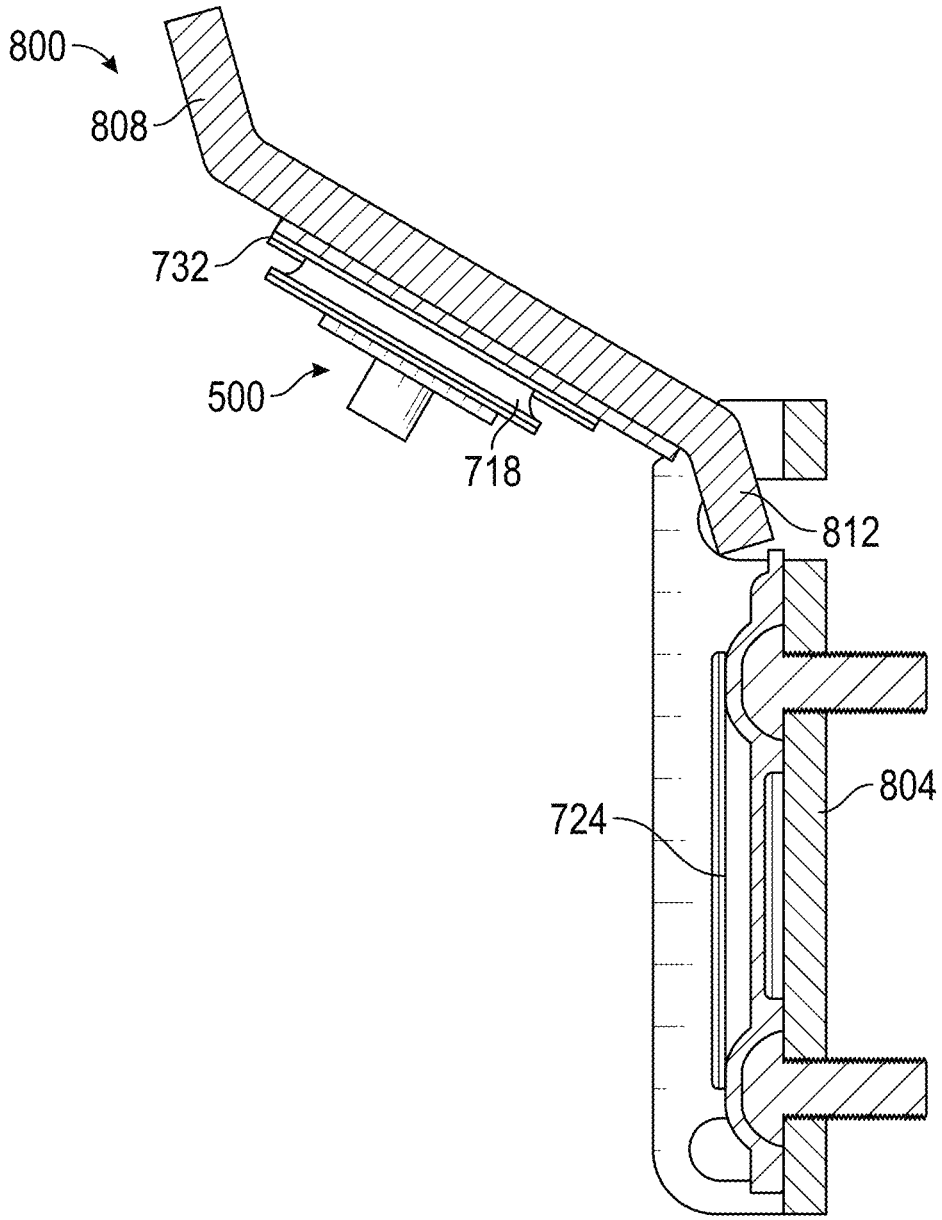
FIG. 15 shows a side view of an example fluid guard assembly that includes the fluid guard and a portion of a lock box housing.

FIG. 15 shows a side view of an example fluid guard assembly 800 that includes the fluid guard 702 and a portion of an access panel 804. The access panel 804 may be a portion of an access box, such as a lock box, a key access port (for example, for a garage or gate entry access), a security compartment or cabinet, etc. The guard door 708 can be attached to an access panel door or latch 808. For example, it may be attached using an adhesive, as described herein. Additionally, or alternatively, the guard base 707 can be adhered to the access panel 804. The access panel latch 808 may be rotatably connected to the access panel 804 via an access panel hinge 812. The access panel 804 may be to any access box such as any of the lock boxes described herein (for example, firefighter box, police box, ambulance box, parking structure box, home box, etc.) or key access device. For example, such a device may include a KNOX-BOX® device or a KNOX® Gate and Key Switch device. The fluid guard 702 may also be used in connection with a KNOX® Fire Department Connection (FDC) Lock device, such as in a KNOX® FDC Locking Cap device. For example, a KNOXBOX® device can be a box that is located on an address side of a building, for example, that can include one or more keys to various rooms (for example, electrical room, panel room, etc.) for which access by fire fighters may be needed in an emergency to get into a property. Only the fire department may have access to such a box.

A KNOX® Gate and Key Switch device can allow firefighters to access an interior of a parking structure or garage. The device can allow firefighters to open a physical barrier, such as an electronic gate, rolling gate, an arm gate, etc. The key can keep a gate in an open position. Using the KNOX® Gate and Key Switch device, firefighters can prevent the spread of fire to other property (for example, vehicles) and/or to people.

Figure 16:
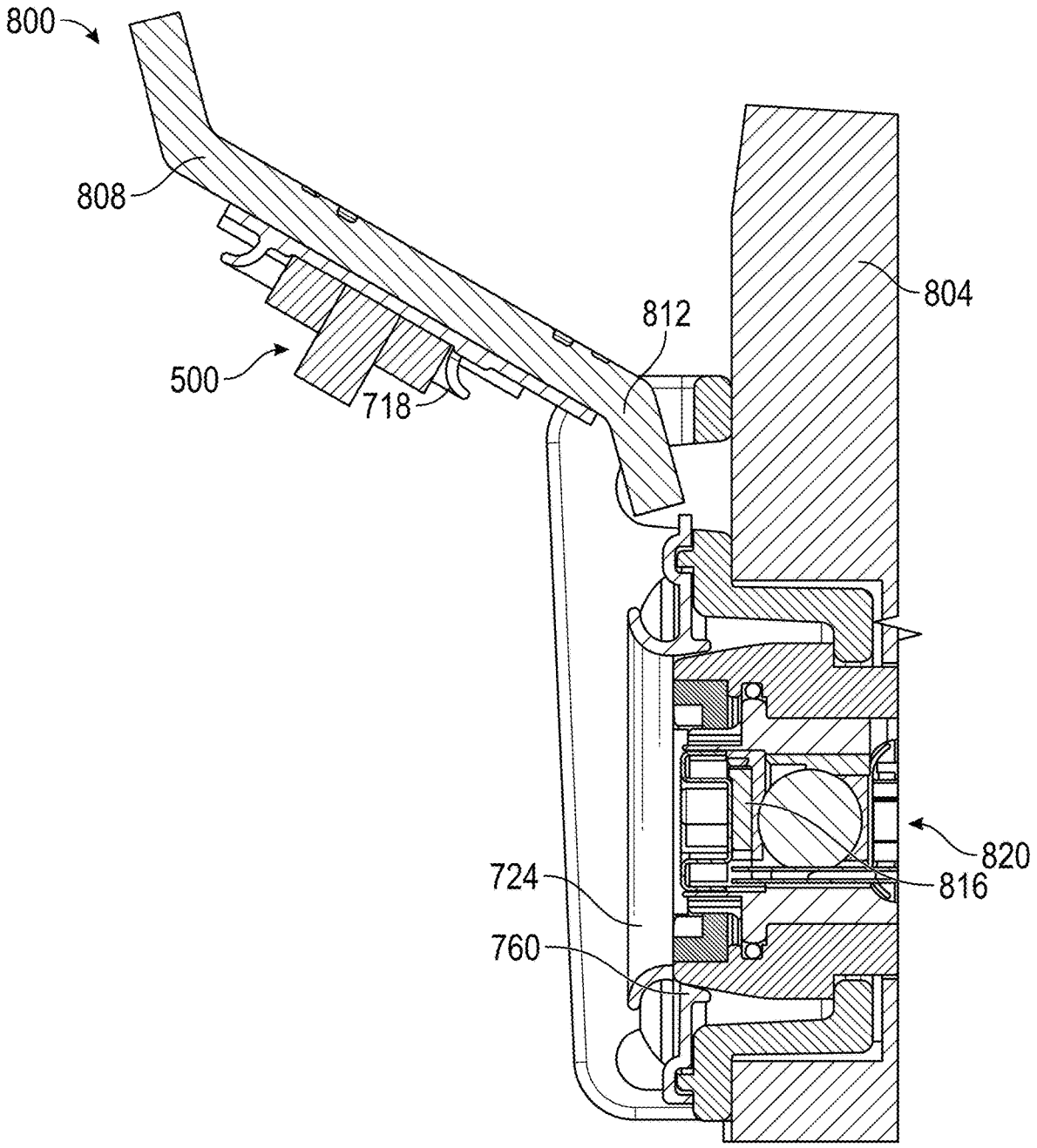
FIG. 16 shows a cross section of a side view of a fluid guard assembly in an open position.

FIG. 16 shows a cross section of a side view of a fluid guard assembly 800 in an open position. The guard door 708 is shown as adjacent the access panel latch 808. The guard door 708 can be attached via, for example, an adhesive. The base flange 724 is seen surrounding at least part of the aperture 740 that exposes a lock face 816 when the fluid guard 702 is open. The lock face 816 allows for access (for example, electronic access) to a lock assembly 820. The base gasket 760 is shown configured to create a seal with the access panel 804.

Figure 17:
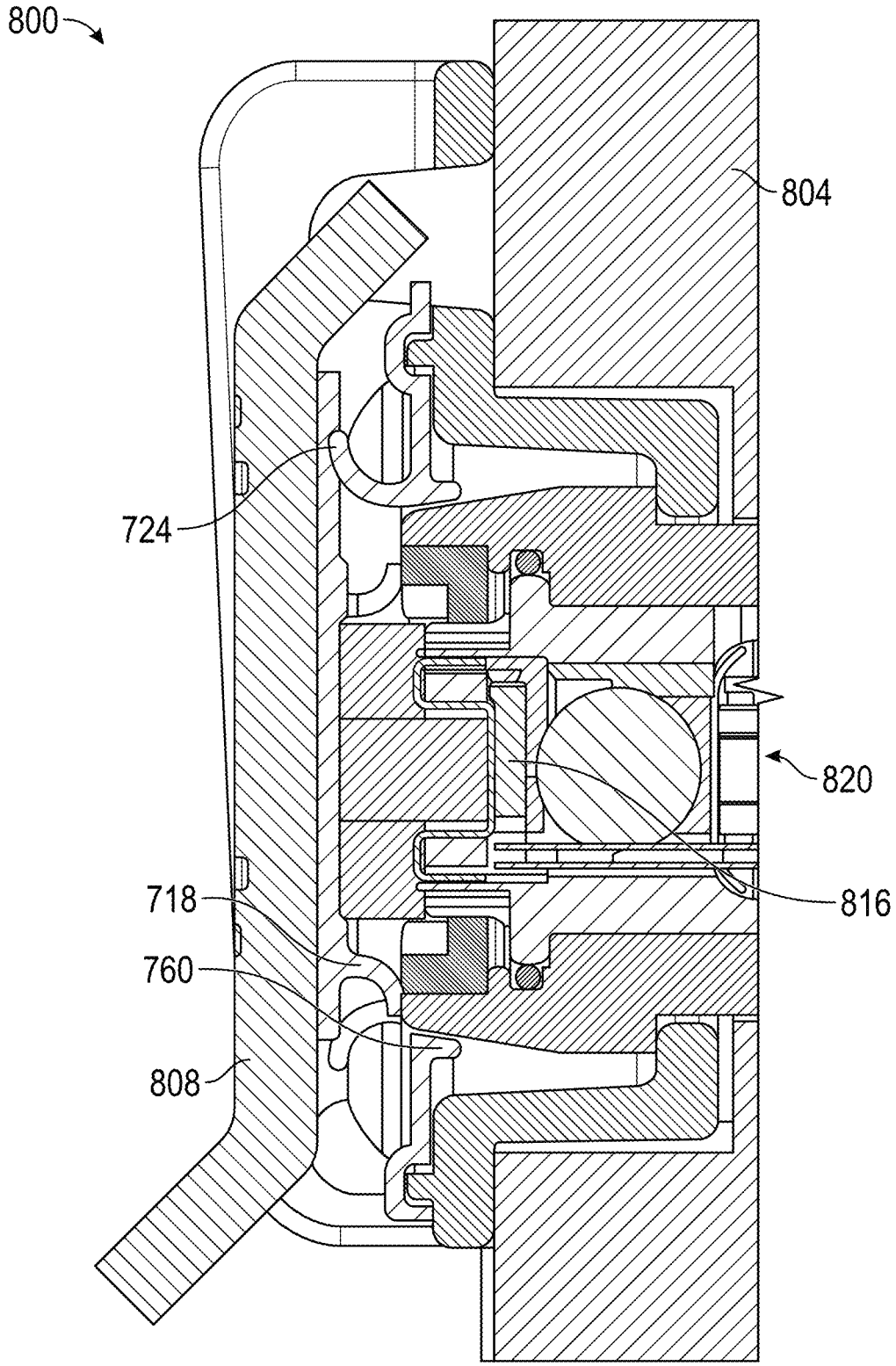
FIG. 17 shows the cross section of FIG. 16 in a closed position.

FIG. 17 shows the cross section of FIG. 16 in a closed position. In the closed position, the base flange 724 can create a seal against the guard door 708, as shown. Additionally or alternatively, the door flange 718 can create a seal against one or more of the guard base 707, the access panel 804, and/or a portion of the lock assembly 820.

Figure 18:
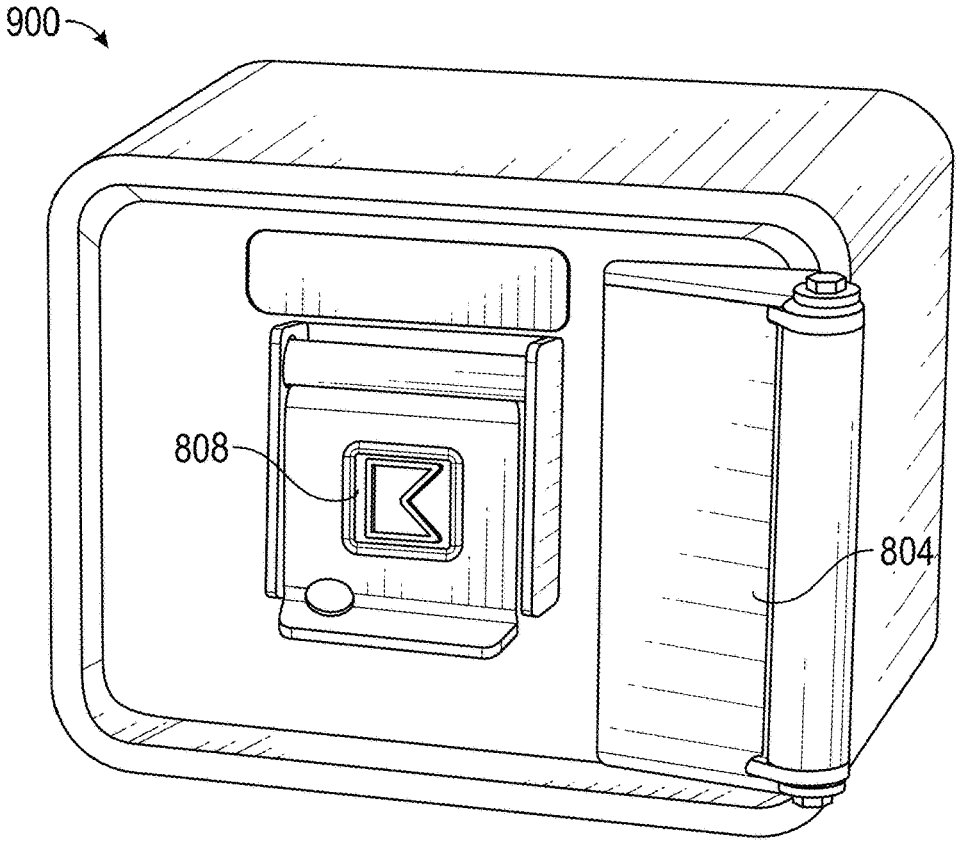
FIG. 18 illustrates an example lock box in which a fluid guard may be used.

FIG. 18 illustrates an example lock box 900 in which a fluid guard 702 may be used. The lock box 900 shown here is a lock box for installation on a wall of a building (for example, an apartment building, a commercial building, etc.), but similar boxes or cabinets may be installed near a parking structure, in an ambulance, or anywhere firefighters or other first responders may require access to respond to an urgent circumstance. The access panel latch 808 shown may be the same access panel latch 808 described herein. Similarly, the access panel 804 shown may be the same or similar to the access panel 804 described herein.

Figure 19:
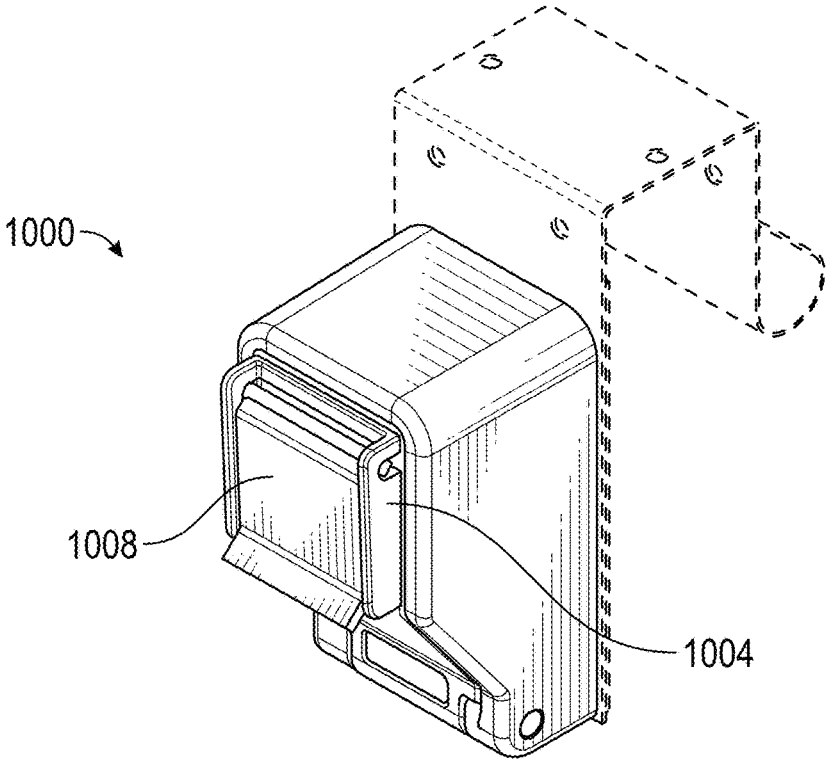
FIG. 19 shows an example key box in which a fluid guard may be used.

FIG. 19 shows an example key box 1000 in which a fluid guard 702 may be used. The key box 1000 as shown includes an access panel 1004 and an access panel latch 1008. The fluid guard 702 may be attached to cooperate mechanically with the access panel latch 1008 and/or the access panel 1004. For example, the fluid guard 702 may be installed on an interior of the access panel latch 1008. The access panel latch 1008 may be analogous to the access panel latch 808. The key box 1000 may be installed anywhere the lock box 900 described herein may be installed. The locking mechanism behind the access panel latch 1008 may allow electronic access to a gate, such as a rolling gate or a bar gate. Additionally or alternatively, the key box 1000 may allow remote unlocking of a latch or locking mechanism of a door.

Figure 20:
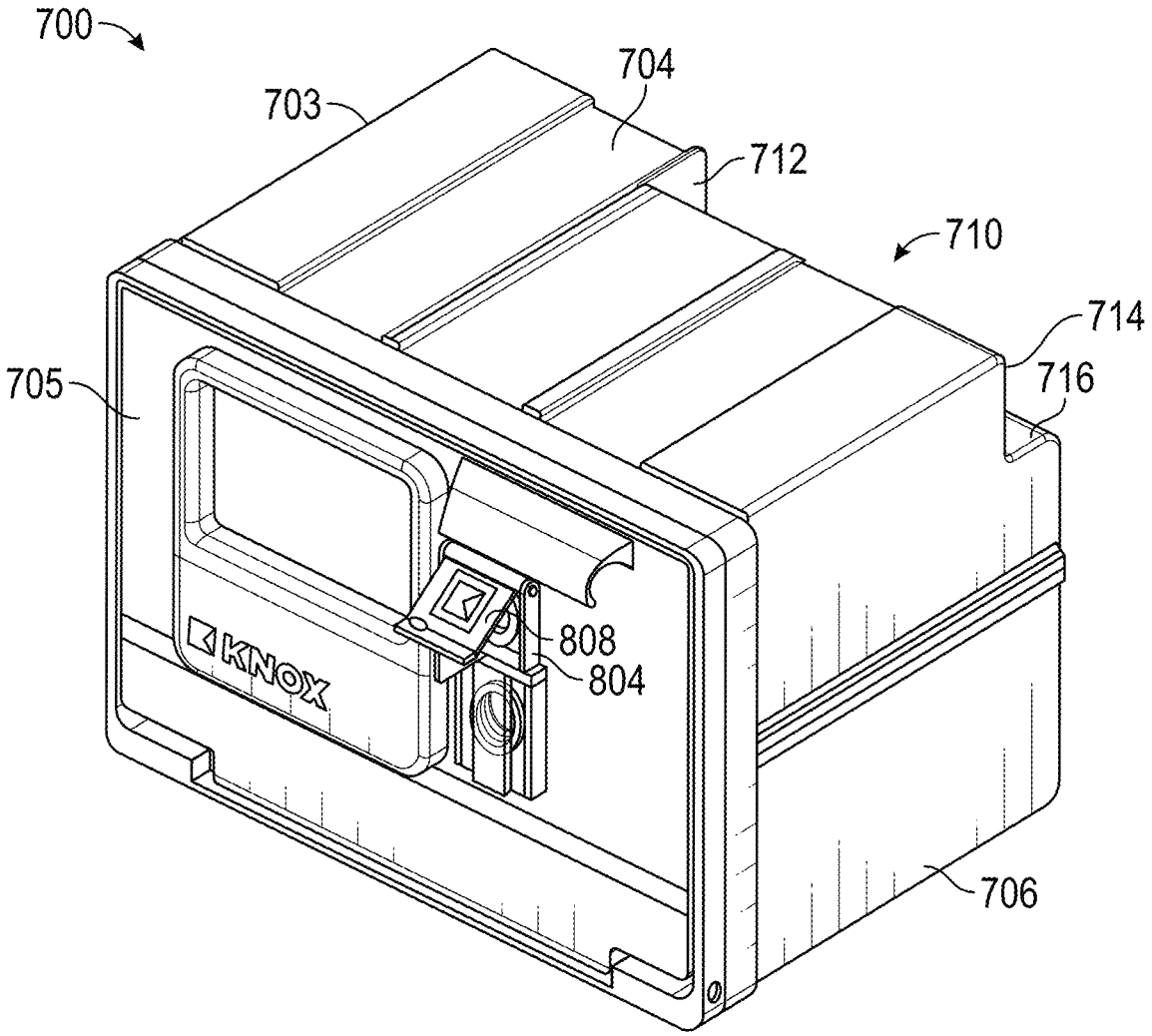
FIG. 20 shows an example lock box or cabinet in which a fluid guard may be used.

FIG. 20 shows an example lock box or cabinet 700 in which the fluid guard 702 may be used. In the depicted embodiment, the cabinet 700 includes a recess 710 in the rear of the cabinet. The recess 710 can enable cables to be directed out of the cabinet and above or to either side of the cabinet without having to require holes to be drilled for the cables in multiple locations.

In some prior cabinets that do not have the recess 710, the cabinets are ordered by customers with specific requests for mounting hole and/or cable hole locations. Cable holes in these prior cabinets could be drilled in the sides of the cabinet, the top, or the rear of the cabinet and may be used to conduct power cable and antenna and other cables or wires out of the cabinet. A power cable can supply power to the cabinet to control circuitry including the processor and associated circuitry and sensors described above as well as the motor. (Although the cabinet can be battery operated, it may be more secure for the cabinet to be powered by an external power source which may be supplied from the wall outlet or from a vehicle that the cabinet is installed in.)

Because cabinets may be installed in different vehicles or buildings which have different mounting configurations, it can be desirable to make the cabinet so that it can go in multiple different mounting locations without requiring holes to be drilled specifically for each cabinet in different locations. A problem has occurred where cabinets would be ordered without specifying the correct cable holes (for example, holes would be drilled where cables could not go, such as against a wall), causing a customer to have to return a cabinet. With the recess 710, cables can be snaked out of the back of the recess to the side, directly to the back, or over the top of the cabinet to the other side of the cabinet—thus addressing this problem at least in part.

As shown in FIG. 20, the recess 710 is depicted in the upper surface 704 of the cabinet 700. The upper wall 704 of the cabinet is a good location for the recess 710 in one embodiment because it allows extensive configurability of different cable locations. The recess 710 can also extend all the way to the wall 706 of the cabinet on one side of the cabinet, but in the depicted embodiment the recess does not extend all the way to the opposite wall of the cabinet so as to provide an increased storage capacity of the cabinet. It is conceivable that for different sized cabinets, the recess 710 may be smaller or larger. For instance, the recess 710 may extend along the entire back length of the cabinet. The recess 710 may also be positioned at the bottom of the cabinet or around one of the sides of the cabinet instead of in the back of the cabinet.

The recess 710 is defined in one embodiment by a wall 712, a shelf 716, and a wall 714. The shelf 716 and the wall 712 are of a sufficient width to enable cables to be snaked out of the cabinet without the cables being pinched against the wall to which the rear of the cabinet is mounted. For instance, in one embodiment the shelf 716 has a depth of about 1.5 inches (about 3.8 cm). The size of the shelf 716 can be driven by the size of the cables and/or antenna used to connect to the back of the cabinet 700. If smaller cables and/or antenna are used, the shelf 716 may be narrower in depth. Likewise, the height of the wall 714 may be smaller or larger depending on the size of the cables and/or antenna used.

Additional details about such lock boxes or cabinets, such as drug boxes or home boxes, that may be used in conjunction with the fluid guard can be found in U.S. application Ser. No. 15/852,326, titled "ELECTRONIC STORAGE CABINET," filed Dec. 22, 2017 ("the '326 application"), which is incorporated by reference herein in its entirety for all purposes.

ADDITIONAL EMBODIMENTS

In other embodiments, the guard head 408 and/or guard body 404 may be made of the same foam material as the fluid absorber 500. In such an embodiment, the guard head 408 and/or body 404 may be integrally formed with the fluid absorber 500 as a single foam piece. A guard head can also be used without using a guard body, such that the guard head covers a lock face.

A cap with a fluid absorber may also be provided for the key 650 shown in FIG. 2. The cleaning cap may be attached to a lanyard in some embodiments.

Figure 21:
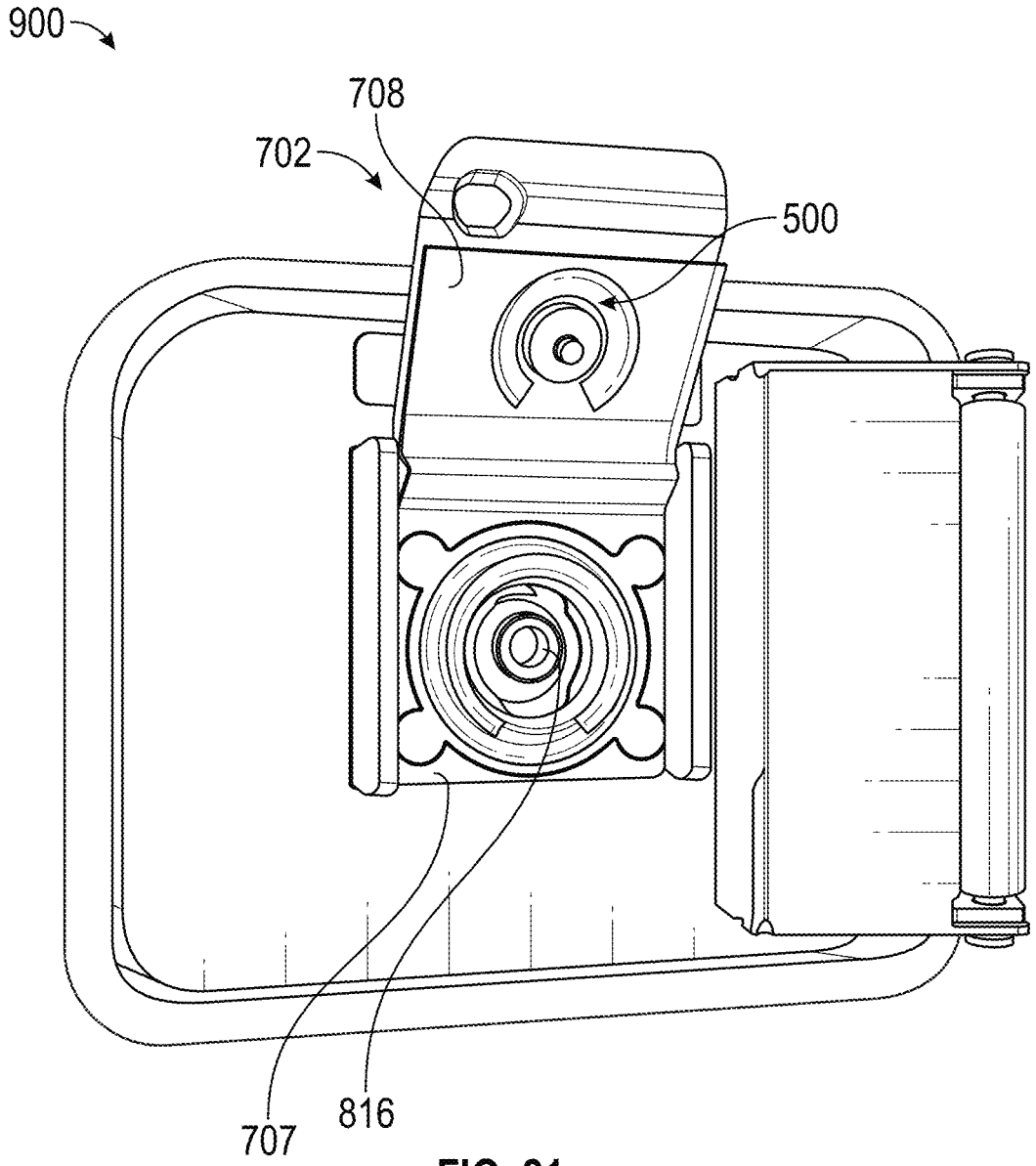
FIG. 21 shows another example of a lock box with a fluid guard.

FIG. 21 shows another example of a lock box 900 with a fluid guard 702.

Figure 22:
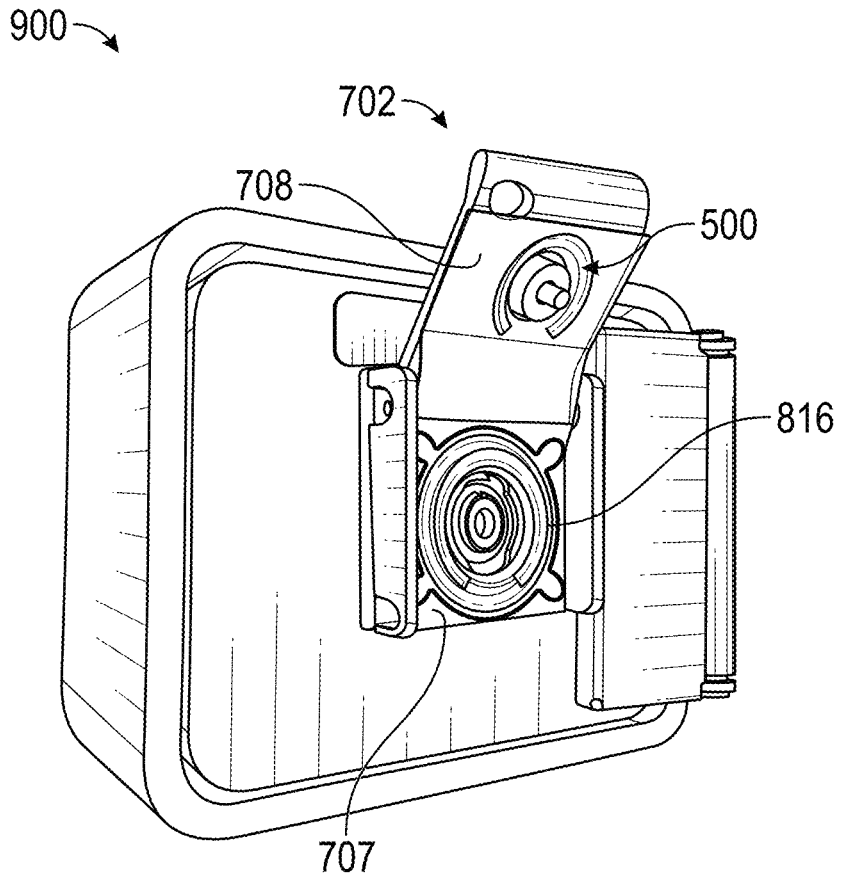
FIG. 22 shows another example lock box in an open configuration.

As shown, the fluid absorber 500 can be configured to fit within and/or contact a surface of the lock face 816. FIG. 22 shows another example lock box 900 in an open configuration.

EXAMPLES

The following examples are meant by way of example only and are not limiting to the number of other available alternatives.

In a 1st example, a locking device guard comprises: a guard head comprising: a fluid absorber; a frame shaped to receive the fluid absorber; and a fastening mechanism; a guard body coupled with an electronic lock, the guard body comprising: an aperture configured to: expose a face of the electronic lock, and receive the fluid absorber; and a fastening receiver configured to mate with the fastening mechanism; a hinge connecting the guard head and the guard body and configured to define an open position and a closed position of the locking device guard.

In a 2nd example, the locking device guard of example 1, wherein the fluid absorber is configured to absorb at least 3 times its weight in fluid.

In a 3rd example, the locking device guard of any of examples 1-2, wherein the fluid absorber comprises a synthetic polymer.

In a 4th example, the locking device guard of any of examples 1-3, wherein the fluid absorber comprises polyvinyl alcohol.

In a 5th example, the locking device guard of any of examples 1-4, wherein the fluid absorber comprises an antimicrobial agent.

In a 6th example, the locking device guard of example 5, wherein the antimicrobial agent comprises silver.

In a 7th example, the locking device guard of any of examples 1-6, wherein the locking device guard comprises a resilient material.

In a 8th example, the locking device guard of any of examples 1-7, wherein the locking device guard comprises silicone.

In a 9th example, the locking device guard of any of examples 1-8, wherein the guard body further comprises a rim surrounding at least a portion of the aperture.

In a 10th example, the locking device guard of any of examples 1-9, wherein the guard head further comprises a fastening body that defines an air outlet, the air outlet providing fluid communication between an exterior of the locking device guard in a closed position and a locking device.

In a 11th example, the locking device guard of any of examples 1-10, wherein the locking device guard has a length and a width, the length being greater than the width.

In a 12th example, a locking device guard head comprising: a fluid absorber configured to: be inserted into a cup of a face of a lock, and absorb fluid from the face of the lock; a frame shaped to receive the fluid absorber; and a fastening mechanism; wherein the locking device guard head is configured to prevent a flow of fluid from an exterior of the guard head to the face of the lock.

In a 13th example, the locking device guard head of example 12, further comprising a hinge configured to connect to a guard body, the guard head configured to define an open position and a closed position.

In a 14th example, the locking device guard head of example 13, wherein fluid absorber is configured to fit into an aperture of the guard body.

In a 15th example, the locking device guard head of example 12, wherein the lock comprises an electronic lock.

In a 16th example, the locking device guard head of any of examples 12-15, wherein the fluid absorber comprises a synthetic polymer.

In a 17th example, the locking device guard head of any of examples 12-16, wherein the fluid absorber comprises polyvinyl alcohol.

In a 18th example, the locking device guard head of any of examples 12-17, wherein the fluid absorber comprises an antimicrobial agent.

In a 19th example, the locking device guard head of example 18, wherein the antimicrobial agent comprises silver.

In a 20th example, the locking device guard head of any of examples 12-19, wherein the locking device guard head comprises silicone.

In a 21st example, the locking device guard for use on an access panel of an access box, the locking device guard comprising: a latch of the access panel; a guard door attached to the latch of the access panel, the guard door comprising a fluid absorber; a guard base attached to the access panel of the access box, the guard base comprising: an aperture configured to: expose a face of an electronic lock disposed within the access panel; and receive the fluid absorber so as to permit the fluid absorber to contact the face of the electronic lock and to thereby permit absorption of fluid off of the face of the electronic lock; and a flange disposed at least partially about the aperture; and a hinge connecting the guard base and the guard door and configured to define an open position and a closed position of the locking device guard.

In a 22nd example, the locking device guard of example 21, wherein the guard door further comprises a door flange disposed at least partially about the fluid absorber.

In a 23rd example, the locking device guard of example 22, wherein the door flange is configured to guide fluid away from the fluid absorber.

In a 24th example, the locking device guard of any of examples 22-23, wherein the door flange is configured to fit at least partially within the aperture.

In a 25th example, the locking device guard of any of examples 22-24, wherein the door flange comprises a vent configured to allow, in the closed position, fluid communication between the fluid absorber and an exterior of the locking device guard.

In a 26th example, the locking device guard of any of examples 21-25, wherein the base flange comprises a vent configured to allow, in the closed position, fluid communication between the fluid absorber and an exterior of the locking device guard.

In a 27th example, the locking device guard of any of examples 21-26, wherein the guard door further comprises one or more fluid guides disposed at least partially along one or more edges of the guard door.

In a 28th example, the locking device guard of example 27, wherein the one or more fluid guides are configured to contact the guard base in the closed position.

In a 29th example, the locking device guard of any of examples 21-28, wherein the guard base further comprises a gasket configured to create a seal between the locking device guard and the face of the electronic lock.

In a 30th example, the locking device guard of example 29, wherein the gasket is disposed on a side opposite the base flange through the aperture.

In a 31st example, the locking device guard of any of examples 21-30, further comprising an adhesive.

In a 32nd example, the locking device guard of example 31, wherein the adhesive is disposed on a back surface of the locking device guard, the back surface being opposite a surface on which one or more of the fluid absorber or flange are disposed.

In a 33rd example, the locking device guard of any of examples 21-32, wherein the locking device guard comprises silicone.

In a 34th example, the locking device guard of any of examples 21-33, wherein the locking device guard comprises a material having a durometer of type A of between 25 and 35.

In a 35th example, the locking device guard of any of examples 21-34, wherein the fluid absorber comprises polyvinyl alcohol.

In a 36th example, the locking device guard of any of examples 21-35, wherein the fluid absorber comprises an antimicrobial agent.

In a 37th example, the locking device guard of example 36, wherein the antimicrobial agent comprises silver.

In a 38th example, the locking device guard of any of examples 21-37, wherein the locking device guard comprises a resilient material.

In a 39th example, the locking device guard of any of examples 21-38, wherein the base has a length and a width, the length being less than 50% greater than the width.

In a 40th example, the locking device guard of any of examples 21-39, wherein one or both of the flange or door flange comprise a curved profile forming an ear configured to guide fluid flow therein.

In a 41st example, the locking device guard of any of examples 21-40, wherein the access box comprises a storage container configured to secure supplies usable by first responders.

In a 42nd example, the locking device guard of any of examples 21-40, wherein the access box comprises a key access port for control of a gate.

In a 43rd example, the locking device guard of any of examples 1-11, wherein the locking device guard is configured for attachment to a padlock.

In a 44th example, the locking device guard of any of examples 1-11 or 43, wherein the locking device guard is configured for attachment to a lock box.

In a 45th example, the locking device guard of any of examples 1-11 or 43-44, wherein the fluid absorber is axially symmetric about an absorber axis.

In a 46th example, the locking device guard of any of examples 1-10 or 43-45, wherein the fluid absorber is shaped to conform to the face of the electronic lock.

In a 47th example, the locking device guard of any of examples 1-10 or 43-46, wherein a shape of the fluid absorber comprises a disk.

In a 48th example, the locking device guard of any of examples 1-10 or 43-47, wherein the fluid absorber is configured to enter an interior cup of the electronic lock.

In a 49th example, the locking device guard of any of examples 1-10 or 43-48, wherein the fastening mechanism comprises a ledge configured to mate with a corresponding ledge of the guard body.

In a 50th example, the locking device guard of any of examples 1-10 or 43-49, wherein the fastening mechanism is disposed near a distal end of the guard head in relation to the hinge.

In a 51st example, the locking device guard of any of examples 1-10 or 43-50, wherein the aperture is configured to receive the fluid absorber so as to permit the fluid absorber to contact the face of the electronic lock and to thereby permit absorption of fluid off of the face of the electronic lock.

Terminology

Although certain embodiments and examples are disclosed herein, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent.

Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment. Accordingly, no feature or group of features is necessary or indispensable to each embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of any claims which follow should not be limited by the particular embodiments described above.

What is claimed is:

1. A locking device guard comprising:
- a guard head comprising:
  - a fluid absorber; and
  - a frame shaped to receive the fluid absorber, the frame comprising a projection with a fastening mechanism extending from the projection, the projection disposed near a distal end of the guard head;
- a guard body configured to be coupled with an electronic lock and comprising a through hole for receiving the projection, and a complimentary retention mechanism that engages the fastening mechanism on the projection, the guard body comprising an aperture configured to:
  - expose a face of the electronic lock, and
  - receive the fluid absorber together with at least a portion of the frame of the guard head; and
- a hinge connecting the guard head and the guard body, the hinge configured to define an open position and a closed position of the locking device guard.

2. The locking device guard of claim 1, wherein the fluid absorber is axially symmetric about an absorber axis and is shaped to conform to the face of the electronic lock.

3. The locking device guard of claim 1, wherein the fluid absorber comprises an antimicrobial agent.

4. The locking device guard of claim 3, wherein the antimicrobial agent comprises silver.

5. The locking device guard of claim 1, wherein the locking device guard comprises a resilient material.

6. The locking device guard of claim 1, wherein the locking device guard comprises silicone or polyurethane.

7. The locking device guard of claim 1, wherein the guard body further comprises a rim surrounding at least a portion of the aperture.

8. The locking device guard of claim 1, wherein the aperture is configured to receive the fluid absorber so as to permit the fluid absorber to contact the face of the electronic lock and to thereby permit absorption of fluid off of the face of the electronic lock.

9. The locking device guard of claim 1, wherein the locking device guard comprises a material having a durometer of type A of between about 10 and 50.

10. A locking device guard head comprising:
- a fluid absorber configured to:
  - be inserted into a cup of a face of a lock, and
  - absorb fluid from the face of the lock; and
- a frame shaped to substantially surround the fluid absorber and configured to be inserted into an aperture of a guard body and to be positioned adjacent the cup of the face of the lock, the frame comprising a projection with a fastening mechanism extending from the projection, the projection disposed near a distal end of the guard head, the projection configured to engage with a through hole on the guard body and the fastening mechanism configured to engage with a complimentary retention mechanism on the guard body,
- wherein the locking device guard head is configured to prevent a flow of fluid from an exterior of the locking device guard head to the face of the lock.

11. The locking device guard head of claim 10, further comprising a hinge configured to connect to the guard body, the hinge configured to define an open position or a closed position of the locking device guard head relative to the guard body.

12. The locking device guard head of claim 11, wherein the fluid absorber is configured to fit into the aperture of the guard body.

13. A locking device guard useable with an access panel of an access box, the locking device guard comprising:
- a guard door attached to a latch of the access panel, the guard door comprising a fluid absorber, wherein the guard door further comprises a door flange shaped to receive the fluid absorber and to be disposed partially about the fluid absorber, the door flange forms a partially annular collar;
- a guard base configured to attach to the access panel of the access box, the guard base comprising:
  - an aperture configured to:
    - expose a face of an electronic lock disposed within the access panel; and
    - receive the fluid absorber or at least a portion of the door flange of the guard door; and
  - a flange disposed partially about the aperture and configured to couple to the door flange, the flange forms a partially annular collar couple to the door flange; and
- a hinge connecting the guard base and the guard door, the hinge configured to define an open position and a closed position of the guard door relative to the guard base.

14. The locking device guard of claim 13, wherein the guard base further comprises a gasket configured to create a seal between the locking device guard and the face of the electronic lock.

15. The locking device guard of claim 13, wherein the door flange is configured to guide fluid away from the fluid absorber.

16. The locking device guard of claim 13, wherein the door flange is configured to fit at least partially within the aperture.

17. The locking device guard of claim 13, wherein the door flange comprises a vent configured to allow, in the closed position, fluid communication between the fluid absorber and the flange.

18. The locking device guard of claim 13, wherein the locking device guard comprises silicone or polyurethane.

19. The locking device guard of claim 13, wherein the guard door further comprises one or more fluid guides disposed at least partially along one or more edges of the guard door.

20. The locking device guard of claim 19, wherein the one or more fluid guides are configured to contact the guard base in the closed position.

* * * * *